US007707722B1

(12) United States Patent
Kothari

(10) Patent No.: US 7,707,722 B1
(45) Date of Patent: May 4, 2010

(54) TECHNIQUE FOR SETTING PRECIOUS STONES SUCH AS DIAMONDS BY A COMBINATION OF PRONGS AND A GROOVE IN A PERIPHERAL WALL

(75) Inventor: Premkumar L. Kothari, Mumbai (IN)

(73) Assignee: Fine Jewellery (India) Ltd., Mumbai (IN)

( * ) Notice: Subject to any disclaimer, the term of this patent is extended or adjusted under 35 U.S.C. 154(b) by 1254 days.

(21) Appl. No.: 11/219,074

(22) Filed: Sep. 1, 2005

(51) Int. Cl.
*A44C 27/00* (2006.01)

(52) U.S. Cl. ..... 29/896.412; 29/10; 29/896.4; 29/896.41; 29/896.411; 63/20; 63/27; 63/28; D11/34; D11/36; D11/37; D11/92

(58) Field of Classification Search ..... 29/10, 29/896.412, 896.4, 896.41, 896.411; 63/20, 63/27, 28; D11/34, 36, 37, 92
See application file for complete search history.

(56) References Cited

U.S. PATENT DOCUMENTS

| | | | | | |
|---|---|---|---|---|---|
| 604,763 | A | * | 5/1898 | Keplinger | 63/20 |
| 677,075 | A | | 6/1901 | Fuchs | |
| 736,022 | A | | 8/1903 | Rhode | |
| 1,238,721 | A | * | 8/1917 | Birnbaum et al. | 63/28 |
| 1,818,324 | A | * | 8/1931 | Hamin | 63/28 |
| 2,058,978 | A | * | 10/1936 | Hamin | 63/28 |
| 2,774,231 | A | | 12/1956 | Peterson | |
| 4,731,913 | A | * | 3/1988 | Plantureux et al. | 29/10 |
| 4,748,728 | A | * | 6/1988 | Magnien et al. | 29/10 |
| 4,761,865 | A | * | 8/1988 | Magnien et al. | 29/10 |
| 5,099,660 | A | * | 3/1992 | Dostourian | 63/28 |
| 5,437,167 | A | * | 8/1995 | Ambar | 63/26 |
| 5,765,398 | A | * | 6/1998 | Bardisbanyan | 63/26 |
| 5,881,795 | A | * | 3/1999 | Uptain | 164/9 |
| D409,518 | S | | 5/1999 | Ho | |
| 6,393,680 | B1 | * | 5/2002 | Chan | 29/10 |
| D480,659 | S | | 10/2003 | Pachauer | |
| D485,509 | S | | 1/2004 | Shagalov | |
| D498,699 | S | | 11/2004 | Shagalov | |
| D549,612 | S | * | 8/2007 | Kothari | D11/91 |
| 7,461,452 | B1 | * | 12/2008 | Kothari | 29/896.412 |

* cited by examiner

*Primary Examiner*—Rick K Chang
(74) *Attorney, Agent, or Firm*—Thomas I. Rozsa

(57) ABSTRACT

A novel technique for setting a multiplicity of precious stones such as diamonds into a unique setting to enhance the beauty and presentation of the multiplicity of set stones, with the technique including setting a center stone into a socket and having it held by a multiplicity of prongs, an outer series of small stones wherein each outer stone is respectively placed in a socket and is held in most designs by a pair of the same prongs which hold the center stone and is also held by a lower groove in the interior facing surface of the outer wall, and an intermediate series of stones which are placed in a respective socket and are held by a pair of the prongs which also retain the center stone and in most designs all of the smaller stones and are also retained by a groove in the interior facing surface of the outer wall, the intermediate series of stones also serving to retain the small series of stones.

6 Claims, 20 Drawing Sheets

ISOMETRIC VIEW

OVAL

FRONT VIEW

BACK VIEW

ISOMETRIC VIEW

O1

SETTING STEPS

STEP 1.

STEP 2.

STEP 3.

O2

MEASUREMENTS FOR 0.50CTS MODEL

O3

PRODUCT

FRONT VIEW

BACK VIEW

ISOMETRIC VIEW

PRODUCT

FRONT VIEW

BACK VIEW

ISOMETRIC VIEW

ROUND

FRONT VIEW

BACK VIEW

ISOMETRIC VIEW

R1

SETTING STEPS

STEP 1.

STEP 2.

STEP 3.

R2

MEASUREMENTS FOR 0.50CTS MODEL

R3

PRODUCT

FRONT VIEW

BACK VIEW

ISOMETRIC VIEW

R4

PRODUCT

FRONT VIEW

BACK VIEW

ISOMETRIC VIEW

SQUARE

FRONT VIEW

BACK VIEW

ISOMETRIC VIEW

S1

SETTING STEPS

STEP 1.

STEP 2.

STEP 3.

S2

MEASUREMENTS FOR 0.50CTS MODEL

S3

PRODUCT

FRONT VIEW

BACK VIEW

ISOMETRIC VIEW

S4

PRODUCT

FRONT VIEW

BACK VIEW

ISOMETRIC VIEW

S5

TRILLION

FRONT VIEW

BACK VIEW

ISOMETRIC VIEW

T1

SETTING STEPS

STEP 1.

STEP 2.

STEP 3.

T2

MEASUREMENTS FOR 0.50CTS MODEL

T3

PRODUCT

FRONT VIEW

BACK VIEW

ISOMETRIC VIEW

T4

PRODUCT

FRONT VIEW

BACK VIEW

ISOMETRIC VIEW

T5

TECHNIQUE FOR SETTING PRECIOUS STONES SUCH AS DIAMONDS BY A COMBINATION OF PRONGS AND A GROOVE IN A PERIPHERAL WALL

BACKGROUND OF THE INVENTION

1. Field of the Invention

The present invention relates to the field of jewelry and more particularly to precious stones such as diamonds. The present invention focuses on the area of jewelry which is involved with setting precious stones such as diamonds into a mounting.

2. Description of the Prior Art

In general, the techniques for setting diamonds and other precious stones have been known for many centuries. The following ten (10) patents are relevant to the present invention:

1. U.S. Pat. No. 677,075 issued to R. Fuchs on Jun. 25, 1901 for "Cluster Setting" (hereinafter the "Fuchs Patent");
2. U.S. Pat. No. 736,022 issued to F. W. Rhode on Aug. 11, 1903 for "Cluster Setting for Rings, Brooches, or the Like" (hereinafter the "Rhode Patent");
3. U.S. Pat. No. 1,818,324 issued to S. A. Hamin on Aug. 11, 1931 for "Means and Method for Mounting Stones and the Like" (hereinafter the "'324 Hamin Patent");
4. U.S. Pat. No. 2,058,978 issued to S. A. Hamin on Sep. 14, 1935 for "Jewel Mounting" (hereinafter the "'978 Hamin Patent");
5. U.S. Pat. No. 2,774,231 issued to H. Peterson on Dec. 28, 1953 for "Mounting Having a Large Central Gem Overlying Adjacent Small Gems" (hereinafter the "Peterson Patent");
6. U.S. Pat. No. 5,009,660 issued to Dostourian on Mar. 31, 1992 for "Mounting for Gem Stones" (hereinafter the "Dostourian Patent");
7. U.S. Pat. No. Des. 409,518 issued to Nelson Chi Kai Ho on May 11, 1999 for "Diamond Article of Jewelry" (hereinafter the "Ho Patent");
8. U.S. Pat. No. D480,659 S issued to Werner Pachauer on Oct. 14, 2003 for "The Ornamental Design for Overlap Setting" (hereinafter the "Pachauer Patent");
9. U.S. Pat. No. D485,509 S issued to Simon Shagalov on Jan. 20, 2004 for "Jewelry Precious Stone Arrangement" (hereinafter the "'509 Shagalov Patent");
10. U.S. Pat. No. D498,699 S issued to Simon Shagalov on Nov. 23, 2004 for "Precious Stone Arrangement" (hereinafter the "'699 Shagalov Patent").

The Fuchs Patent which issued in 1901 has as its concept the use of a sheet metal ring with annular series of extending prongs which support the stones. The sheet metal ring is shown in FIG. 4.

The Rhode Patent which issued in 1903 discloses a cluster setting.

The '324 Hamin Patent has a base member 11 is secured to a shank of the ring and the base comprises a shell having an upstanding wall 12 which is struck or serrated so as to generally conform to the outer edges of the series of encircling stones. The central stone member illustrated in FIG. 3 is provided with an upstanding wall 21 having a plain or pointed top from which extends an inwardly directed shoulder 22 and a depending inwardly inclined wall or flange 23.

The '978 Hamin Patent which issued in 1936 has a jewelry mounting as best illustrated in FIG. 3 where one stone is mounted above another.

The Peterson Patent is a mounting having a large central gem overlying adjacent small gems. In this case as you can see, the smaller gems are supported by prongs and then the large overlying gems partially cover those smaller gems.

The Dostourian Patent is a mounting for gem stones which basically shows a plurality of large round diamonds and small round diamonds with the pavilion portion of the large round diamonds bearing directly upon and overlying, at least a portion, of the crown of the smaller round diamonds such that individual metallic prongs for the diamonds are eliminated.

The Ho Patent is a design patent which protects the shape of the object wherein there are a multiplicity of smaller stones with a large stone covering a portion of the smaller stones.

The Pachauer Patent is also a design patent that protects the shape of the jewelry design. The design is that of an overlapping setting which shows a center stones surrounded by six stones, one above, one below and two on each side.

The '509 Shagalov Patent is a jewelry arrangement of precious stones which is also a design patent. This design arrangement has the center stone above the other stones.

The '699 Shagalov Patent is a design patent that protects the concept of overlaying stones wherein the center stone is supported by four stones on the outside and there are four lower stones which the center stone covers.

SUMMARY OF THE INVENTION

The present invention is a novel technique for setting a multiplicity of precious stones such as diamonds into a unique setting to enhance the beauty and presentation of the multiplicity of set stones, with the technique including setting a center stone into a socket and having it held by a multiplicity of prongs, an outer series of small stones wherein each outer stone is respectively placed in a socket and is held in most designs by a pair of the same prongs which hold the center stone and is also held by a lower groove in the interior facing surface of the outer wall, and an intermediate series of stones which are placed in a respective socket and are held by a pair of the prongs which also retain the center stone and in most designs all of the smaller stones and are also retained by a groove in the interior facing surface of the outer wall, the intermediate series of stones also serving to retain the small series of stones, especially if in the particular design the small series of stones are not partially held in place by a groove in the outer wall. In an optional design, the outer wall is surrounded by a bezel which contains a multiplicity of stones which are retained by two pairs of prongs. The shape of the outer wall can be oval, circular, square or trillion and if used, the corresponding bezel is the same shape.

It is an object of the present invention to create a technique for setting precious stones in a mounting so that the same multiplicity of prongs or sub-combination pairs of those prongs are used to retain a center stone and at least partially retain an outer series of small stones which are set at a level higher than the center stone and also to at least partially retain a series of intermediate size stones which are set at the highest level in the setting, the intermediate stones also being retained by a groove in the inner facing surface of the outer wall. Optionally, depending upon the shape of the design, the outer series of small stones can also be retained by a lower groove in the inner facing surface of the outer wall. Each of the outer series of small stones are also retained by two adjacent intermediate stones.

It is also an object of the present invention to provide a unique method of setting precious stones which utilizes a combination of prongs and a retaining groove in the interior surface of the outer wall of the setting to retain the stones.

It is a further object of the present invention to provide an outer series of preferably small stones which are respectively held by pairs of prongs, and with an intermediate series of stones which are held by the same prongs which hold the small stones with each intermediate stone being held by two prongs selected one each from an adjacent pair of prongs with the intermediate stones also being partially held in a groove within the interior surface of the outer wall so that each of the intermediate stones at least partially cover a portion of two adjacent outer stones so that the way the outer stones are held is concealed.

It is a another object of the present invention to vary the size of the stones so that the center stone can be the smallest stone or the intermediate stones and the outer stones can be the same size or larger than the center stone.

It is further object of the present invention to vary the size of the stones proportionately so to make the outer dimension smaller or larger. The stones 78 through 88, will be the smallest in the entire mounting. The stones 90 through 100 will be the medium size stones in the entire mounting. And the center stone 76 will be the largest stone in the entire mounting. Further this proportion will always remain the same and will vary accordingly to achieve larger or smaller outer dimension.

It is also an object of the present invention to utilize the setting technique with jewelry in a multiplicity of different shapes such as oval, circular, square and trillion.

It is an additional object of the present invention to further embellish the jewelry design by having an exterior bezel which contains a multiplicity of stones which are held by oppositely disposed pairs of prongs.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
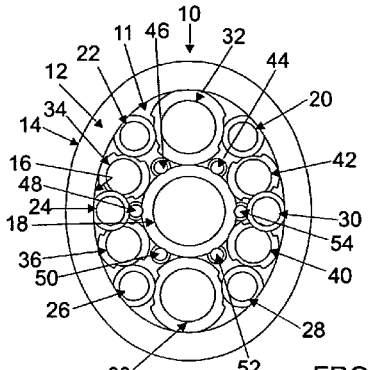
FIG. 1 is a top plan view of an oval shaped jewelry mounting illustrating the orientation of the prongs and the stone retaining sockets without any precious stones retained thereon.
Figure 2:
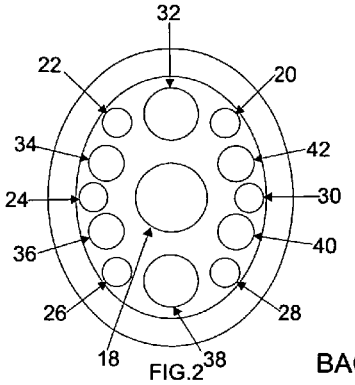
FIG. 2 is a bottom plan view of an oval shaped jewelry mounting illustrating the bottom of the retaining sockets.
Figure 3:
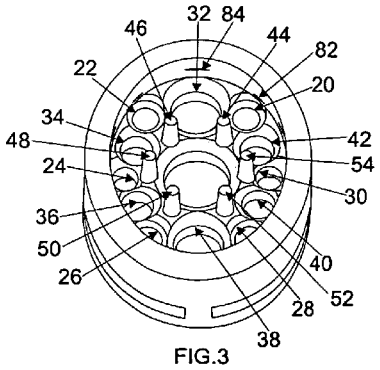
FIG. 3 is a perspective view of an oval shaped jewelry mounting illustrating the orientation of the prongs and the stone retaining sockets without any precious stones retained thereon.

The present invention technique for setting diamonds and other precious stones will first be described with an oval shaped mounting which has a mounting base 10. As illustrated in FIG. 1, the oval shaped mounting base 10 has a floor 11 which is surrounded by an outer wall 12 which has an outer surface 14 and an inner surface 16. Supported on the floor are a multiplicity of sockets into which the precious stones such as diamonds are set. There is a large center socket 18 into which a large center stone will be placed. Adjacent the portion of the floor 11 which lies adjacent the interior surface 14 of outer wall 12 there are a multiplicity of small sockets 20, 22, 24, 26, 28 and 30 which are spaced around the interior of the oval shaped mounting 10. As illustrated in FIG. 3, a portion of each socket 20, 22, 24, 26. 28 and 30 extend into a lower channel or groove 82 in the interior surface 16 of outer wall 12. As illustrated in FIG. 3, the sockets 20, 22, 24, 26, 28 and 30 are at a level slightly lower then center socket 18 and intermediate sockets 32, 34, 36, 38, 40 and 42. Finally, there are a multiplicity of intermediate sockets 32, 34, 36, 38, 40, and 42 wherein a respective intermediate socket is positioned between two small sockets as illustrated in FIG. 1. In this design upper intermediate socket 32 and lower intermediate socket 38 are larger than the other intermediate sockets 34, 36, 40 and 42. As illustrated in FIG. 3, a portion of each intermediate socket 32, 34, 36, 38, 40 and 42 lies adjacent to the interior surface 16 of outer wall 18. Also, as illustrated in FIG. 3, the intermediate sockets 32, 34, 36, 38. 40 and 42 are at a higher level from sockets 20, 22, 24, 26, 28 and 30. FIG. 2 is a bottom plan view of the oval shaped mounting illustrating how the various sockets appear from the bottom of the mounting.

Finally a multiplicity of prongs 44, 46, 48, 50, 52 and 54 are positioned around center socket 18 so that a respective pair of prongs also lies adjacent an intermediate socket 32, 34, 36, 38. 40 and 42. In the oval embodiment, only two of the prongs 48 and 54 lie adjacent a respective small socket 24 and 30 while the prongs do not lie adjacent the outer four small sockets 20, 22, 24, 26 and 28. In embodiments of other shapes which will be discussed, including round, square and trillion, all of the prongs also respectively lie adjacent a respective one of all of the small sockets. As illustrated in FIG. 3, the prongs are generally frustum shaped.

Figure 4:
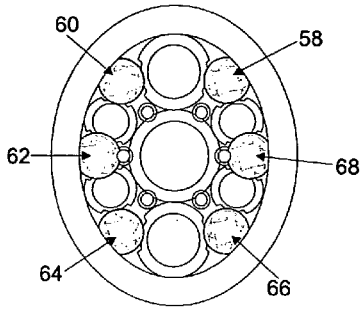
FIG. 4 is a top plan view of an oval shaped jewelry mounting illustrating the first step in the mounting process which is mounting the outer row of small stones wherein each small stone is placed in a respective outer socket and partially retained within a groove in the interior surface of the outer wall with two of the stones each retained by a prong.
Figure 5:
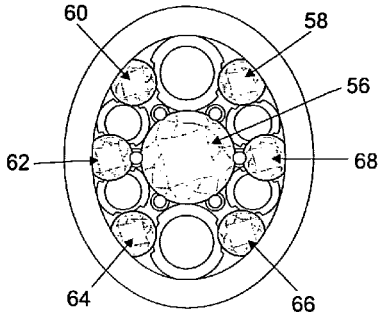
FIG. 5 is a top plan view of an oval shaped jewelry mounting illustrating the second step in the mounting process which is mounting the center stone in the center socket with the stone retained by six prongs.
Figure 4A:
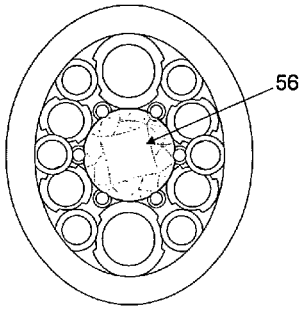
FIG. 4A is a top plan view of an oval shaped jewelry mounting illustrating an alternative first step in the mounting process which is mounting the center large stone first by mounting the center stone in the center socket with the stone retained by six prongs.
Figure 5A:
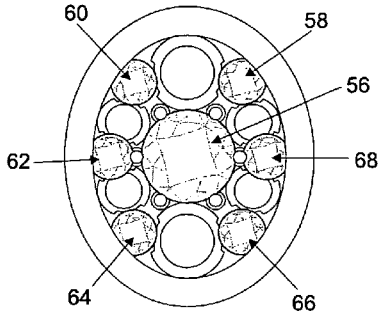
FIG. 5A is a top plan view of an oval shaped jewelry mounting illustrating the second step when the alternative from FIG. 4A is used, wherein the second step involves mounting the outer row of small stones wherein each small stone is placed in a respective outer socket and partially retained within a groove in the interior surface of the outer wall with two of the stones each retained by a prong.
Figure 6:
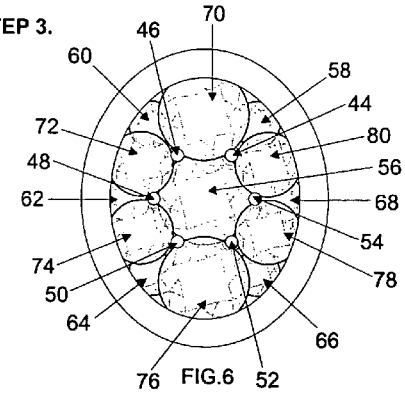
FIG. 6 is a top plan view of an oval shaped jewelry mounting illustrating the third step in the mounting process which is mounting the intermediate size stones so that each stone is partially retained within a groove in the interior surface of the outer wall and partially retained by a pair of prongs so that an intermediate stone partially covers and retains the center stone and a pair of outer small stone.

The stone setting steps for the oval shaped mounting 10 are illustrated in FIGS. 4 through 6. The first step in the process is to mount the small stones in the small sockets. A small stone 58, 60, 62, 64, 66 and 68 is respectively mounted in a small socket 20, 22, 24, 26, 28 and 30 so that the pavilion of each small stone is placed within a respective small socket and a portion of the girdle of each small stone is placed within lower groove 82 and is partially retained in a socket by the groove 82. For small stones 62 and 68, they are also retained by a respective prong 48 and 54.

The next step in the process is to place the large center stone 56 into the larger center socket 18 so that its pavilion is placed into the socket 18. The center stone 56 is held by the six prongs 44, 46, 48, 50, 52 and 54 holding the girdle of the large center stone 56.

While the setting process has been described as setting the small outer stones 58, 60, 62, 64, 66 and 68 first and then setting the large center stone 56, it will be appreciated that it is also within the spirit and scope of the present invention to reverse the process and set the large center stone 56 first and then set the small outer stones 58, 60, 62, 64, 66, and 68.

Figure 7:
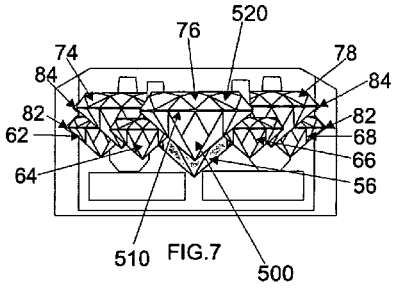
FIG. 7 is a cross sectional view of an oval shaped jewelry mounting showing that the center stone is lowest, the small outer stones are at a level above the center stone and the intermediate stones are at a level above the small outer stones, the cross sectional view also showing that the small outer stones are partially retained in a lower groove in the interior surface of the outer wall and the intermediate stones are partially retained in an upper groove in the interior surface of the outer wall.

As illustrated in FIGS. 6 and 7, the small outer stones 58, 60, 62, 64, 66, and 68 are at a level lower than large center stone 56.

The final step in the process is to set the intermediate stones. Each intermediate stone 70, 72, 74, 76, 78 and 80 is respectively placed into an intermediate socket 32, 34, 36, 38, 40 and 42 so that its pavilion is placed into a socket and a portion of its girdle extends into and is partially retained by upper groove 84 and each intermediate stone is also respectively partially retained by a pair of prongs. As illustrated in FIG. 6, prongs 44 and 46 partially retain larger intermediate stone 70, prongs 46 and 48 partially retain intermediate stone 72, prongs 48 and 50 partially retain intermediate stone 74, prongs 50 and 52 partially retain larger intermediate stone 76, prongs 52 and 54 partially retain intermediate stone 78 and prongs 54 and 44 partially retain intermediate stone 80. The intermediate stones are above the smaller outer stones and are at the highest level in the setting.

In addition, each intermediate stone partially covers, and retains a pair of adjacent smaller outer stones. As illustrated in FIG. 6, in this manner intermediate stone 70 partially covers and thereby partially retains smaller outer stones 58 and 60. Intermediate stone 72 partially covers and thereby partially retains smaller outer stones 60 and 62. Intermediate stone 74 partially covers and thereby partially retains smaller outer stones 62 and 64. Intermediate stone 76 partially covers and thereby partially retains smaller outer stones 64 and 66. Intermediate stone 78 partially covers and thereby partially retains smaller outer stones 66 and 68. Intermediate stone 80 partially covers and thereby partially retains smaller outer stones 68 and 58. Each intermediate stone also partially overlaps center stone 56 and helps to retain it.

Referring to the cross sectional view of FIG. 7, it can be seen that the center stone 56 is at the lowest level, the smaller outer stones 58, 60, 62, 64, 66, and 68 are at the next higher level and are partially retained by channel or groove 82 in the interior surface 16 of outer wall 12 and also partially covered and retained by an intermediate stone, and intermediate stones 70, 72, 74, 76, 78 and 80 are partially retained by a groove or channel 84 in the interior surface 16 of outer wall 12 and also partially retained by a pair of prongs.

Figure 8:
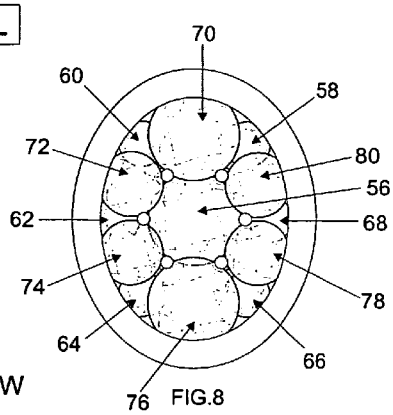
FIG. 8 is a top plan view of an oval shaped jewelry mounting illustrating the completed setting of the stones of the present invention.
Figure 9:
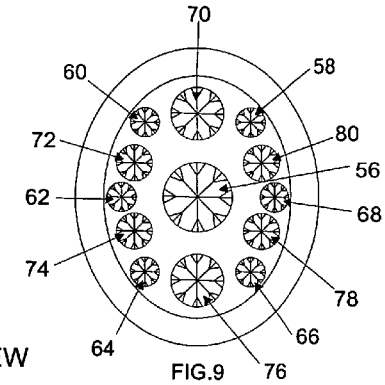
FIG. 9 is a bottom plan view of an oval shaped jewelry mounting illustrating the completed setting of the stones of the present invention.
Figure 10:
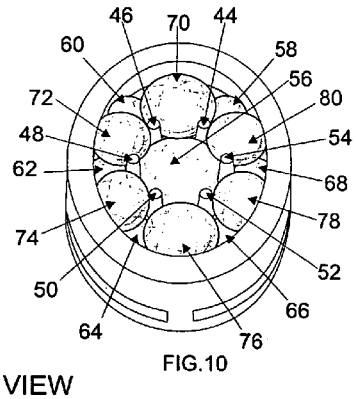
FIG. 10 is a perspective view of an oval shaped jewelry mounting illustrating the completed setting of the stones of the present invention.

The final finished setting for an oval mounting 10 is illustrated in FIGS. 8, 9 and 10.

Figure 11:
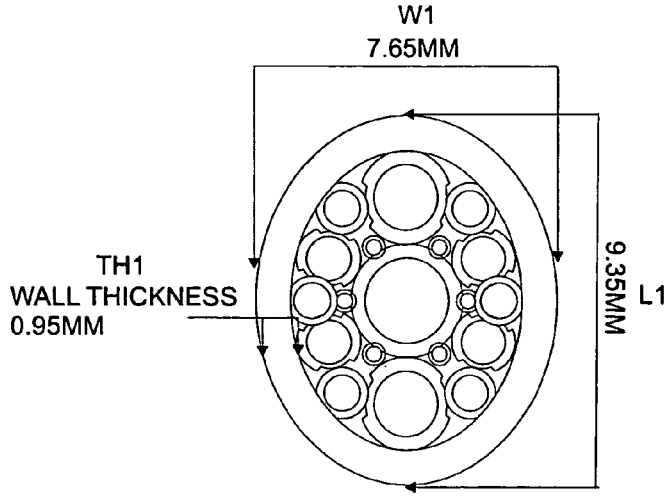
FIG. 11 is a top plan view on an oval shaped mounting for a 0.50 carat stone setting showing the length and width of the mounting and the thickness of the outer wall.
Figure 12:
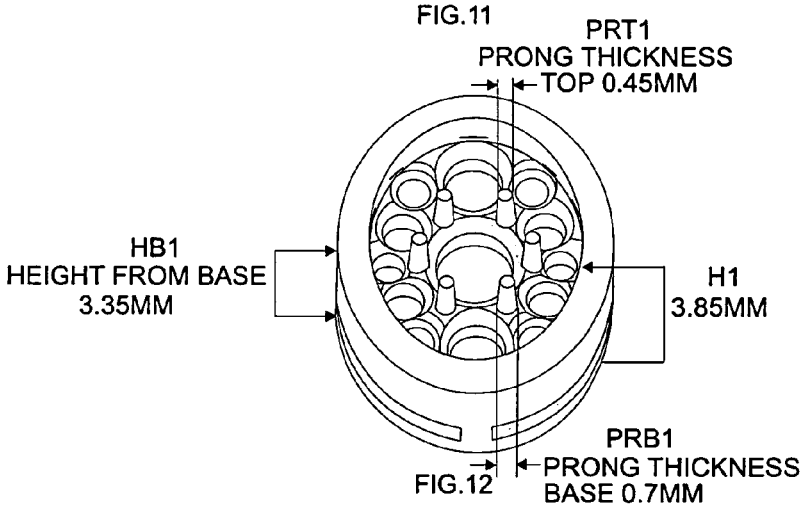
FIG. 12 is a perspective view of an oval shaped mounting for a 0.50 carat stone setting showing the height of the outer wall, the height from the top of the mounting to the base level of the tip of the lowest stone, and the thickness of the top and bottom of the prongs.
Figure 13:
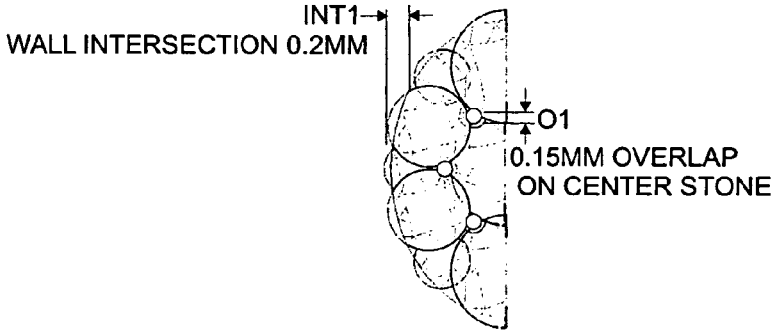
FIG. 13 is a partial top plan view of an oval shaped mounting for a 0.50 carat stone setting showing the depth of the groove into which the intermediate stones are set and showing the amount of overlap of an intermediate stone over the center stone.

Referring to FIGS. 11 through 13, there are illustrated various dimensions for a 0.50 carat model oval setting. It will be appreciated that these dimensions are provided for illustration only and not limitation and other dimensions are within the spirit and scope of the present invention Referring to FIG. 11, the length L1 of the oval mounting 10 can be 9.35 millimeters, the width W1 can be 7.65 millimeters, and the wall thickness TH1 can be 0.95 millimeters Referring to FIG. 12, the overall height H1 of the oval shaped mounting 10 can be 3.85 millimeters and the height HB1 from the base 11 to the top of the mounting can be 3.35 millimeters. With respect to the prongs, the width or thickness PRT1 of the top can be 0.45 millimeters and the width or thickness PRB1 of the bottom can be 0.7 millimeters. Referring to FIG. 13, the depth of the girdle on the intermediate stones penetrating into the channel 84 designated as INT 1 can be 0.2 millimeters and the amount of the overlap O1 of each intermediate stone over the center stone 56 can be 0.15 millimeters.

Figure 14:
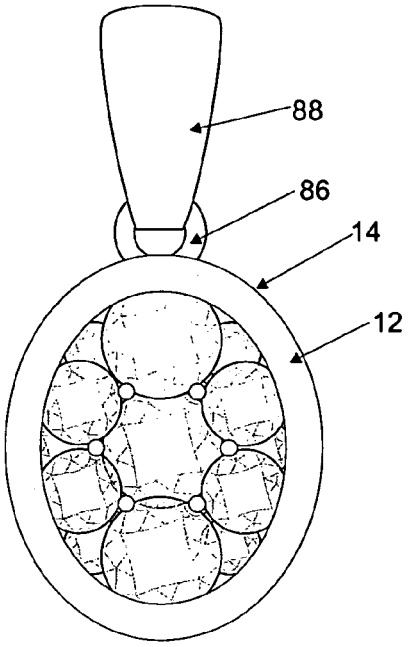
FIG. 14 is a top plan view of an oval shape mounting with all of the stones set therein and the mounting used as a pendant.
Figure 15:
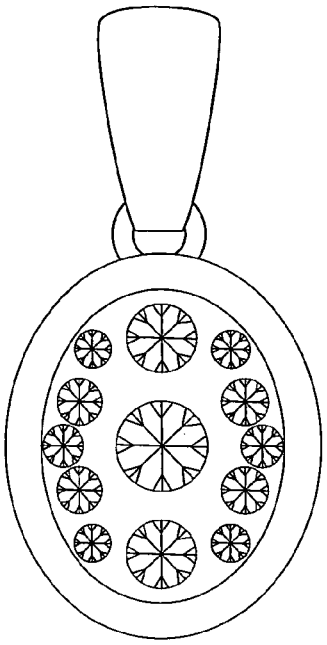
FIG. 15 is a bottom plan view of an oval shape mounting with all of the stones set therein and the mounting used as a pendant.
Figure 16:
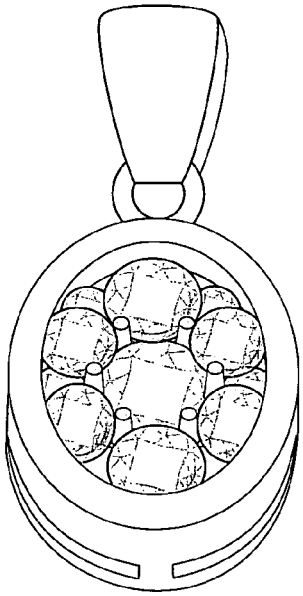
FIG. 16 is a perspective view of an oval shape mounting with all of the stones set therein and the mounting used as a pendant.
Figure 17:
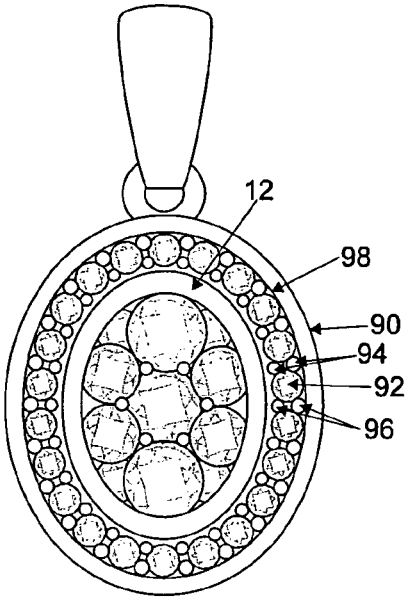
FIG. 17 is a top plan view of an oval shape mounting with all of the stones set therein and having an outer bezel comprising a multiplicity of stones with each stone retained by a pair of oppositely disposed prongs, and the entire mounting used as a pendant.
Figure 18:
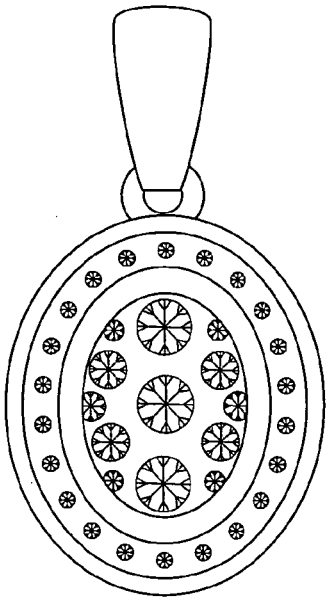
FIG. 18 is a bottom plan view of an oval shape mounting with all of the stones set therein and having an outer bezel comprising a multiplicity of stones with each stone retained by a pair of oppositely disposed prongs, and the entire mounting used as a pendant.
Figure 19:
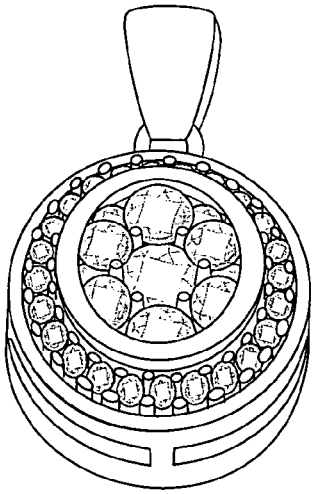
FIG. 19 is a perspective view of an oval shape mounting with all of the stones set therein and having an outer bezel comprising a multiplicity of stones with each stone retained by a pair of oppositely disposed prongs, and the entire mounting used as a pendant.

In one use the oval shaped mounting 10 with the multiplicity of stones set as previously described can be used in a pendant as illustrated in FIGS. 14 through 16 where a portion of the exterior surface 14 of outer wall 12 is fastened to a ring 86 which in is connected to a sleeve 88 which can be worn on a chain. In another use, referring to FIGS. 17 through 19, a bezel 98 which contains an outer wall 90 having a multiplicity of stones 92 retained by two adjacent pairs of prongs 94 and 96 can be used to further embellish the oval shaped mounting 10.

Figure 20:
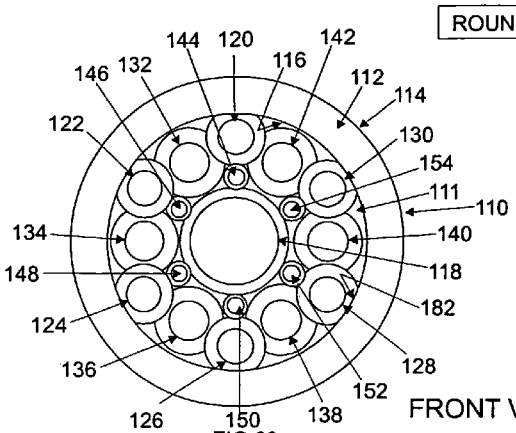
FIG. 20 is a top plan view of a round shaped jewelry mounting illustrating the orientation of the prongs and the stone retaining sockets without any precious stones retained thereon.
Figure 21:
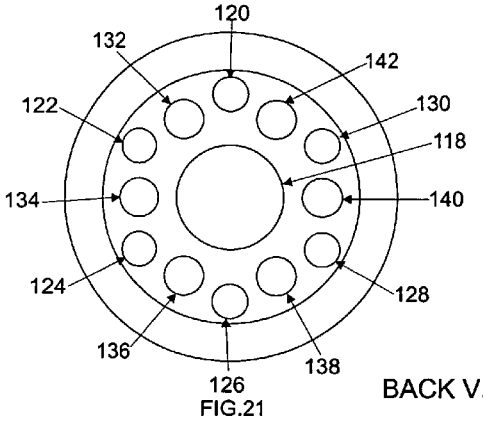
FIG. 21 is a bottom plan view of a round shaped jewelry mounting illustrating the bottom of the retaining sockets.
Figure 22:
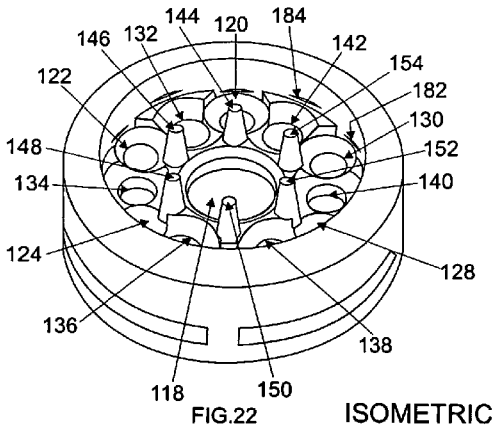
FIG. 22 is a perspective view of a round shaped jewelry mounting illustrating the orientation of the prongs and the stone retaining sockets without any precious stones retained thereon.

The present invention technique for setting diamonds and other precious stones will next be described with a round shaped mounting which has a mounting base 110. As illustrated in FIG. 20, the round shaped mounting base 110 has a floor 111 which is surrounded by an outer wall 112 which has an outer surface 114 and an inner surface 116. Supported on the floor are a multiplicity of sockets into which the precious stones such as diamonds are set. There is a large center socket 118 into which a large center stone will be placed. Adjacent the portion of the floor 111 which lies adjacent the interior surface 116 of outer wall 112 there are a multiplicity of outer sockets 120, 122, 124, 126, 128 and 130 which are spaced around the interior of the round shaped mounting 110. As illustrated in FIG. 20, a portion of each socket 120, 122, 124, 126, 128 and 130 extend into a lower channel or groove 182 in the interior surface 116 of outer wall 112. As illustrated in FIGS. 20 and 22, the sockets 120, 122, 124, 126, 128 and 130 are at a level which is slightly lower than center socket 118 and intermediate sockets 132, 134, 136, 138, 140 and 142. Finally, there are a multiplicity of intermediate sockets 132, 134, 136, 138, 140, and 14 wherein a respective intermediate socket is positioned between two small sockets as illustrated in FIG. 20. As illustrated, all of the intermediate sockets are the same size. As illustrated in FIGS. 20 and 22, a portion of each intermediate socket 132, 134, 136, 138, 140 and 142, lies adjacent to the interior surface 116 of outer wall 118. Also, as illustrated in FIGS. 20 and 22, the intermediate sockets 132, 134, 136, 138, 140 and 142 are at a level above small sockets 120, 122, 124, 126, 128 and 130. FIG. 21 is a bottom plan view of the round shaped mounting illustrating how the various sockets appear from the bottom of the mounting.

Finally a multiplicity of prongs 144, 146, 148, 150, 152 and 154 are positioned around center socket 118 so that a respective prong also lies adjacent an outer sockets 120,122,124, 126,128 and 130 and the intermediate socket 132, 134, 136, 138, 140 and 142. As illustrated in FIG. 22, the prongs are generally frustum shaped.

Figure 23:
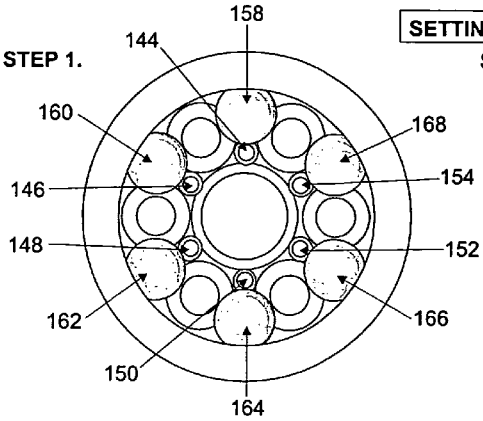
FIG. 23 is a top plan view of a round shaped jewelry mounting illustrating the first step in the mounting process which is mounting the outer row of small stones wherein each small stone is placed in a respective outer socket and partially retained within a groove in the interior surface of the outer wall with each stone retained by a prong.
Figure 24:
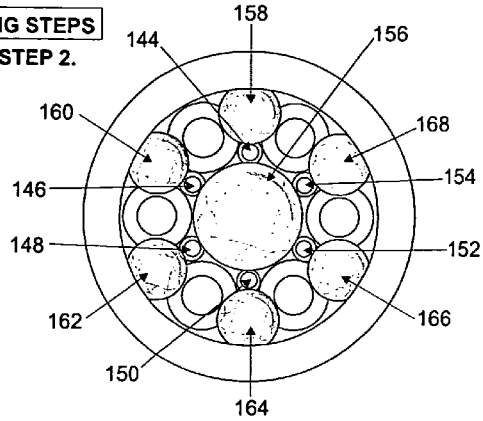
FIG. 24 is a top plan view of a round shaped jewelry mounting illustrating the second step in the mounting process which is mounting the center stone in the center socket with the stone retained by six prongs.
Figure 23A:
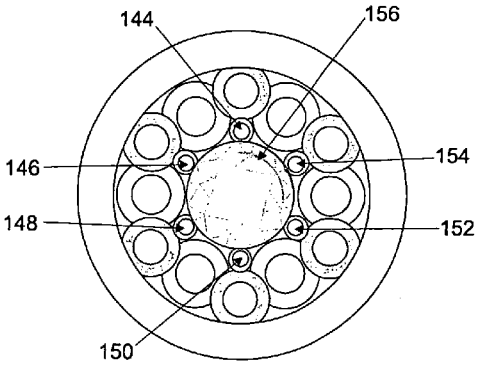
FIG. 23A is a top plan view of a round shaped jewelry mounting illustrating an alternative first step in the mounting process which is mounting the center large stone first by mounting the center stone in the center socket with the stone retained by six prongs.
Figure 24A:
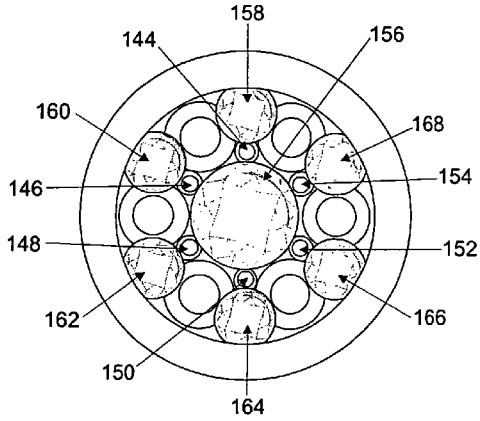
FIG. 24A is a top plan view of a round shaped jewelry mounting illustrating the second step when the alternative from FIG. 23A is used, wherein the second step involves mounting the outer row of small stones wherein each small stone is placed in a respective outer socket and partially retained within a groove in the interior surface of the outer wall with each stone retained by a prong.

The stone setting steps for the round shaped mounting 110 are illustrated in FIGS. 23 and 24. The first step in the process is to mount the outer stones in the outer sockets. An outer stone 158, 160, 162, 164, 166 and 168 is respectively mounted in an outer socket 120, 122, 124, 126, 128 and 130 so that the pavilion of each outer stone is placed within a respective outer socket and a portion of the girdle of each outer stone is placed within lower groove 182 and is partially retained in a socket by the groove 182. Each outer stone is also partially retained by a respective prong, as illustrated in FIG. 23.

The next step in the process is to place the large center stone 156 into the larger center socket 118 so that its pavilion is placed into the socket 118. The center stone 156 is held by the six prongs 144, 146, 148, 150, 152 and 154 holding the girdle of the large center stone 156.

While the setting process has been described as setting the small outer stones 158, 160, 162, 164, 166 and 168 first and then setting the large center stone 156, it will be appreciated that it is also within the spirit and scope of the present invention to reverse the process and set the large center stone 156 first and then set the small outer stones 158, 160, 162, 164, 166, and 168.

As illustrated in FIG. 23, the small outer stones 158, 160, 162, 164, 166, and 168 are at a level below the large center stone 156.

Figure 25:
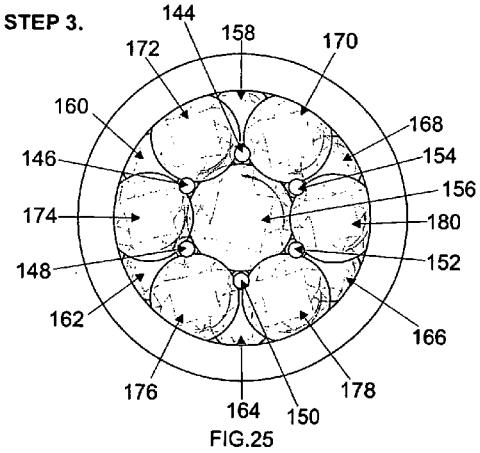
FIG. 25 is a top plan view of a round shaped jewelry mounting illustrating the third step in the mounting process which is mounting the intermediate size stones so that each stone is partially retained within a groove in the interior surface of the outer wall and partially retained by a pair of prongs so that an intermediate stone partially covers and retains the center stone and a pair of outer small stones.

The final step in the process is to set the intermediate stones. Each intermediate stone 170, 172, 174, 176, 178 and 180 is respective placed into an intermediate socket 132, 134, 136, 138, 140 and 142 so that its pavilion is placed into a socket and a portion of its girdle extends into and is partially retained by upper groove 184 and each intermediate stone is also respectively partially retained by a pair of prongs. As illustrated in FIG. 25, prongs 144 and 146 partially retain larger intermediate stone 172, prongs 146 and 148 partially retain intermediate stone 174, prongs 148 and 150 partially retain intermediate stone 176, prongs 150 and 152 partially retain larger intermediate stone 178, prongs 152 and 154 partially retain intermediate stone 180, and prongs 154 and 144 partially retain intermediate stone 170. The intermediate stones are above the smaller outer stones and are at the highest level in the setting.

In addition, each intermediate stone partially covers and retains a pair of adjacent smaller outer stones. As illustrated in FIG. 25, in this manner intermediate stone 170 partially covers and thereby partially retains smaller outer stones 158 and 168. Intermediate stone 172 partially covers and thereby partially retains smaller outer stones 158 and 160. Intermediate stone 174 partially covers and thereby partially retains smaller outer stones 160 and 16. Intermediate stone 176 partially covers and thereby partially retains smaller outer stones 162 and 164. Intermediate stone 178 partially covers and thereby partially retains smaller outer stones 164 and 166. Intermediate stone 180 partially covers and thereby partially retains smaller outer stones 166 and 168. Each intermediate stone also partially overlaps center stone 156 and helps to retain it.

Figure 26:
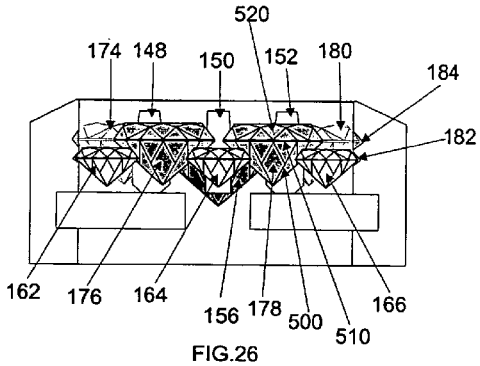
FIG. 26 is a cross sectional view of a round shaped jewelry mounting showing that the center stone is lowest, the small outer stones are at a level above the center stone and the intermediate stones are at a level above the small outer stones, the cross sectional view also showing that the small outer stones are partially retained in a lower groove in the interior surface of the outer wall and the intermediate stones are partially retained in an upper groove in the interior surface of the outer wall.

Referring to the cross sectional view of FIG. 26, it can be seen that the center stone 156 is at the level slightly higher then the outer stones 162, 164 and 166 but, lower than the intermediate stones 174,176,178 and 180 also the center stone 156 is held by 6 prongs and is partially covered and retained by an intermediate stones. Smaller outer stones 162, 164, and 166 are at the lowest level and are held by single prong and partially retained by channel or groove 182 which is in the interior surface 116 of outer wall 112 and also partially covered and retained by an intermediate stone, and intermediate stones 174,176,178 and 180 are partially retained by a groove or channel 184 in the interior surface 116 of outer wall 112 and also partially retained by a pair of prongs.

Figure 27:
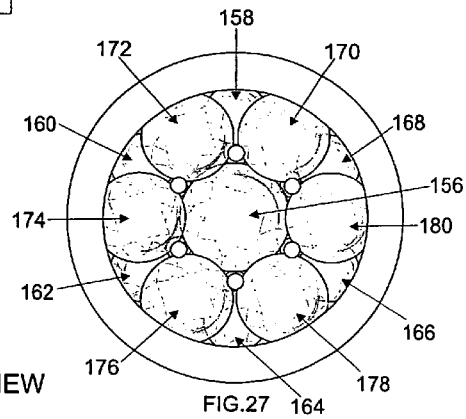
FIG. 27 is a top plan view of a round shaped jewelry mounting illustrating the completed setting of the stones of the present invention.
Figure 28:
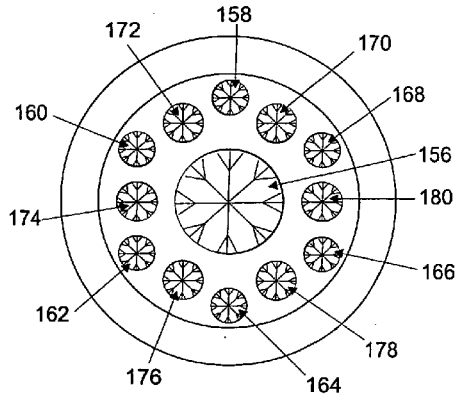
FIG. 28 is a bottom plan view of a round shaped jewelry mounting illustrating the completed setting of the stones of the present invention.
Figure 29:
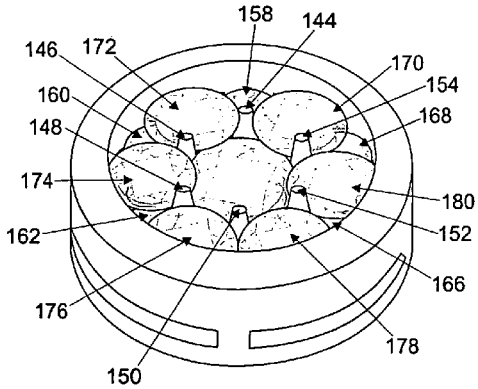
FIG. 29 is a perspective view of a round shaped jewelry mounting illustrating the completed setting of the stones of the present invention.

The final finished setting for a round mounting 110 is illustrated in FIGS. 27, 28 and 29.

Figure 30:
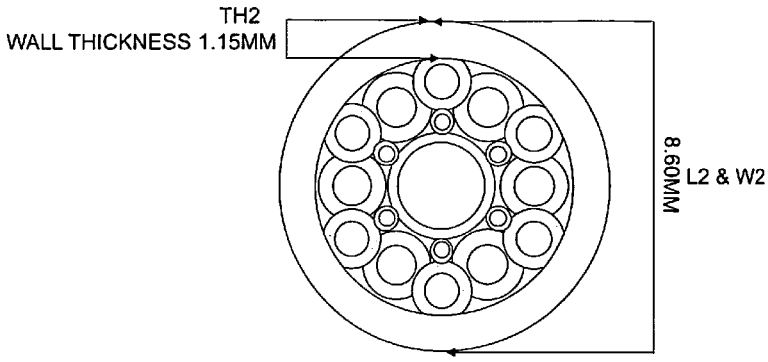
FIG. 30 is a top plan view on a round shaped mounting for a 0.50 carat stone setting showing the length and width of the mounting and the thickness of the outer wall.
Figure 31:
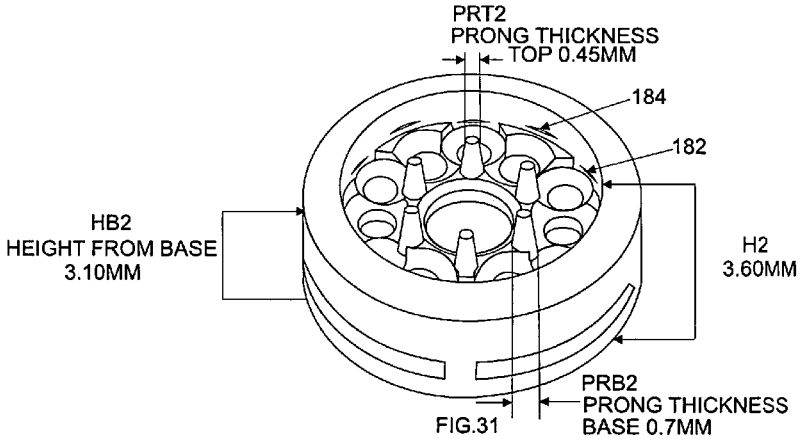
FIG. 31 is a perspective view of a round shaped mounting for a 0.50 carat stone setting showing the height of the outer wall, the height from the top of the mounting to the base level of the tip of the lowest stone, and the thickness of the top and bottom of the prongs.
Figure 32:
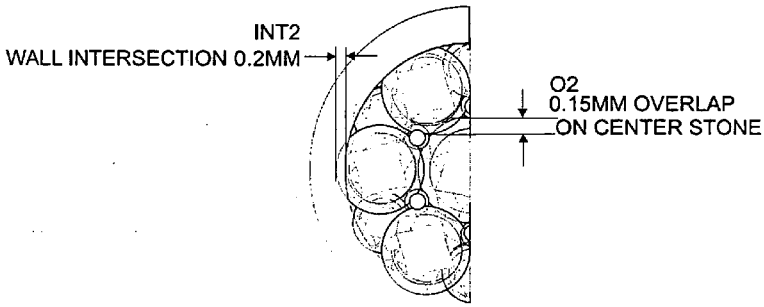
FIG. 32 is a partial top plan view of a round shaped mounting for a 0.50 carat stone setting showing the depth of the groove into which the intermediate stones are set and showing the amount of overlap of an intermediate stone over the center stone.

Referring to FIGS. 30 through 32, there are illustrated various dimensions for a 0.50 carat model round setting. It will be appreciated that these dimensions are provided for illustration only and not limitation and other dimensions are within the spirit and scope of the present invention. Referring to FIG. 30, the length L2 and width W2 of the round mounting 110 can be 8.6 millimeters, and the wall thickness TH2 can be 1.15 millimeters. Referring to FIG. 31, the overall height H2 of the round shaped mounting 110 can be 3.6 millimeters and the height HB2 from the base 111 to the top of the mounting can be 3.10 millimeters. With respect to the prongs, the width or thickness PRT2 of the top can be 0.45 millimeters and the width or thickness PRB2 of the bottom can be 0.7 millimeters. Referring to FIG. 32, the depth of the girdle on the intermediate stones penetrating into the channel 184 designated as INT 2 can be 0.2 millimeters and the amount of the overlap 02 of each intermediate stone over the center stone 156 can be 0.15 millimeters.

Figure 33:
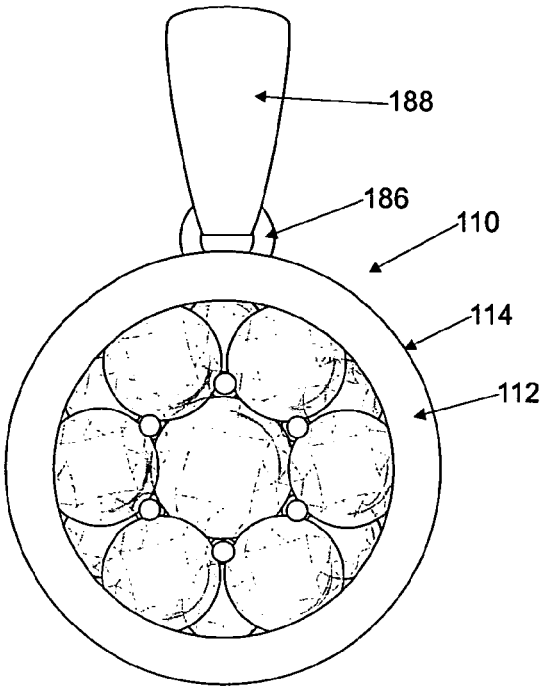
FIG. 33 is a top plan view of a round shaped mounting with all of the stones set therein and the mounting used as a pendant.
Figure 34:
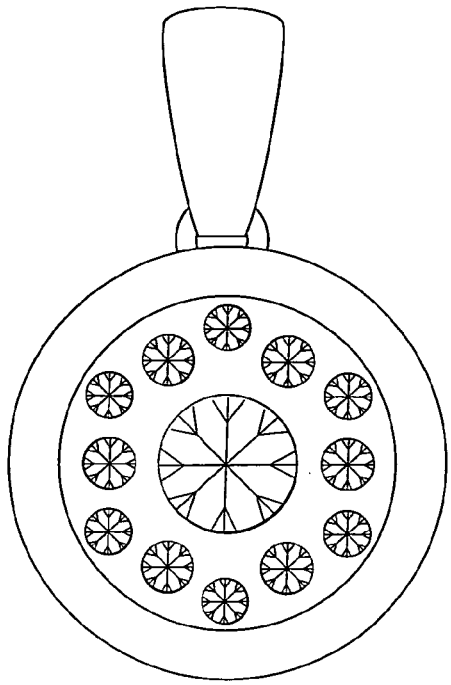
FIG. 34 is a bottom plan view of a round shape mounting with all of the stones set therein and the mounting used as a pendant.
Figure 35:
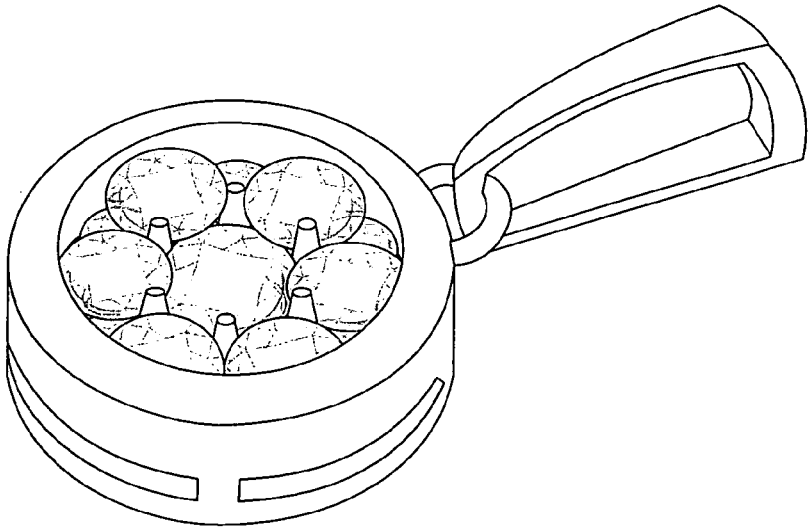
FIG. 35 is a perspective plan view of a round shape mounting with all of the stones set therein and the mounting used as a pendant.
Figure 36:
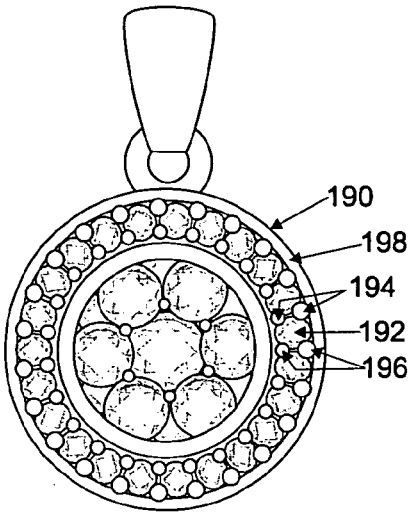
FIG. 36 is a top plan view of a round shape mounting with all of the stones set therein and having an outer bezel comprising a multiplicity of stones with each stone retained by a pair of oppositely disposed prongs, and the entire mounting used as a pendant.
Figure 37:
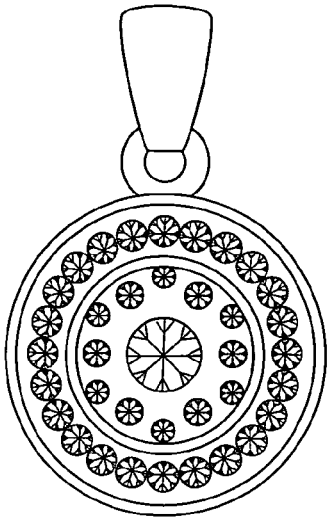
FIG. 37 is a bottom plan view of a round shape mounting with all of the stones set therein and having an outer bezel comprising a multiplicity of stones with each stone retained by a pair of oppositely disposed prongs, and the entire mounting used as a pendant.
Figure 38:
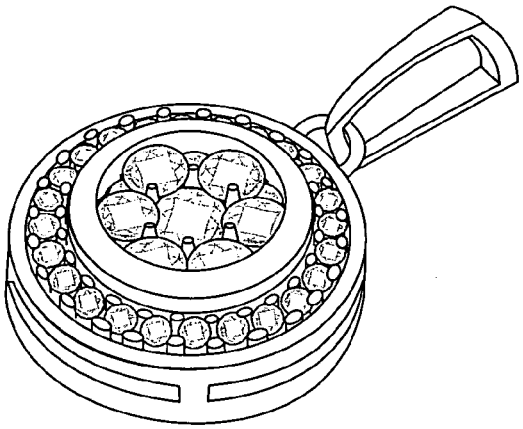
FIG. 38 is a perspective view of a round shape mounting with all of the stones set therein and having an outer bezel comprising a multiplicity of stones with each stone retained by a pair of oppositely disposed prongs, and the entire mounting used as a pendant.

In one use the round shaped mounting 110 with the multiplicity of stones set as previously described can be used in a pendant as illustrated in FIGS. 33 through 35 where a portion of the exterior surface 114 of outer wall 112 is fastened to a ring 186 which in is connected to a sleeve 188 which can be worn on a chain. In another use, referring to FIGS. 36 through 38, a bezel 198 which contains an outer wall 190 having a multiplicity of stones 192 retained by two adjacent pairs of prongs 194 and 196 can be used to further embellish the round shaped mounting 110.

Figure 39:
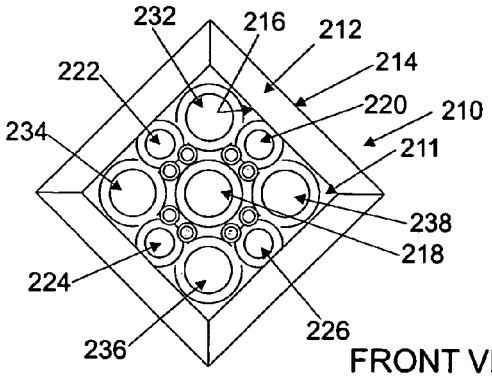
FIG. 39 is a top plan view of a square shaped jewelry mounting illustrating the orientation of the prongs and the stone retaining sockets without any precious stones retained thereon.
Figure 40:
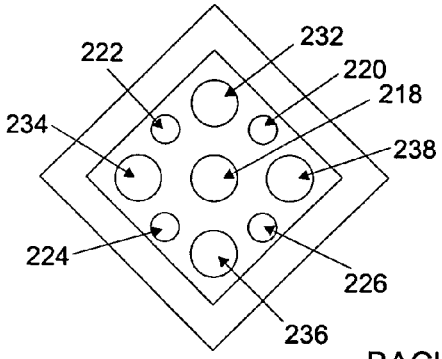
FIG. 40 is a bottom plan view of a square shaped jewelry mounting illustrating the bottom of the retaining sockets.
Figure 41:
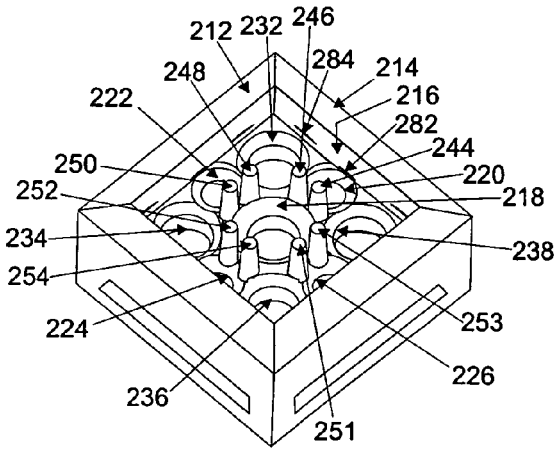
FIG. 41 is a perspective view of a square shaped jewelry mounting illustrating the orientation of the prongs and the stone retaining sockets without any precious stones retained thereon.

The present invention technique for setting diamonds and other precious stones will next be described with a square shaped mounting which has a mounting base 210. As illustrated in FIG. 39, the square shaped mounting base 210 has a floor 211 which is surrounded by an outer wall 212 which has an outer surface 214 and an inner surface 216. Supported on the floor are a multiplicity of sockets into which the precious stones such as diamonds are set. There is a large center socket 218 into which a large center stone will be placed. Adjacent the portion of the floor 211 which lies adjacent the interior surface 216 of outer wall 212 there are a multiplicity of outer sockets 220, 222, 224 and 226 which are spaced around the interior of the square shaped mounting 210. As illustrated in FIGS. 39 and 41, a portion of each socket 220, 222, 224 and 226 extends into a lower channel or groove 282 in the interior surface 216 of outer wall 212. As illustrated in FIG. 41, the sockets 220, 222, 224 and 226 are at a level which is below center socket 218 and intermediate sockets 232, 234, 236, and 238. Finally, there are a multiplicity of intermediate sockets 232, 234, 236 and 238 wherein a respective intermediate socket is positioned between two outer sockets as illustrated in FIG. 39. As illustrated, all of the intermediate sockets are the same size. As illustrated in FIGS. 39 and 41, a portion of each intermediate socket 232, 234, 236 and 238 lies adjacent to the interior surface 216 of outer wall 218. Also, as illustrated in FIG. 41, the intermediate sockets 232, 234, 236 and 238 are at a level higher than the outer sockets 220, 222, 224 and 226. FIG. 40 is a bottom plan view of the square shaped mounting illustrating how the various sockets appear from the bottom of the mounting.

Finally a multiplicity of prongs 244, 246, 248, 250, 252, 254, 251 and 253 are positioned around center socket 218 so that a respective pair of prongs also lies adjacent an intermediate socket 232, 234, 236 and 238 and a different pair of prongs also lies adjacent an outer socket 220, 222, 224 and 226. As illustrated in FIG. 41, the prongs are generally frustum shaped.

Figure 42:
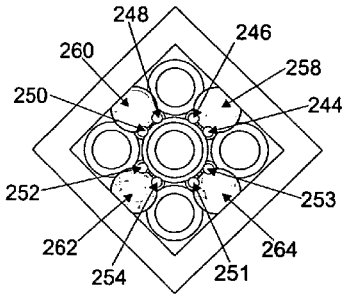
FIG. 42 is a top plan view of a square shaped jewelry mounting illustrating the first step in the mounting process which is mounting the outer row of small stones wherein each small stone is placed in a respective outer socket and partially retained within a groove in the interior surface of the outer wall with each stone retained by a pair of prongs.
Figure 43:
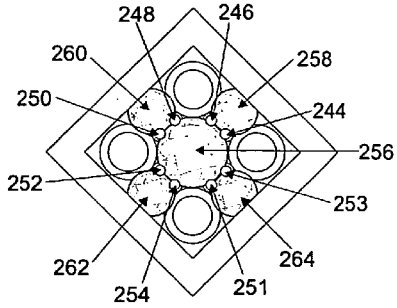
FIG. 43 is a top plan view of a square shaped jewelry mounting illustrating the second step in the mounting process which is mounting the center stone in the center socket with the stone retained by eight prongs.
Figure 42A:
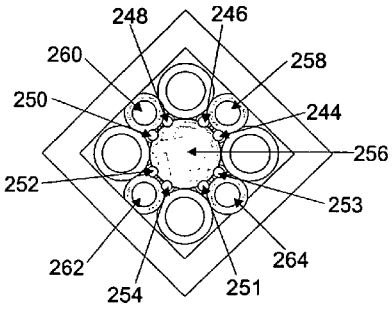
FIG. 42A is a top plan view of a square shaped jewelry mounting illustrating an alternative first step in the mounting process which is mounting the center large stone first by mounting the center stone in the center socket with the stone retained by eight prongs.
Figure 43A:
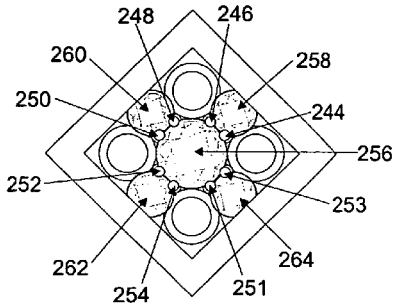
FIG. 43A is a top plan view of a square shaped jewelry mounting illustrating the second step when the alternative from FIG. 42A is used, wherein the second step involves mounting the outer row of small stones wherein each small stone is placed in a respective outer socket and partially retained within a groove in the interior surface of the outer wall each stone retained by a pair of prongs.
Figure 44:
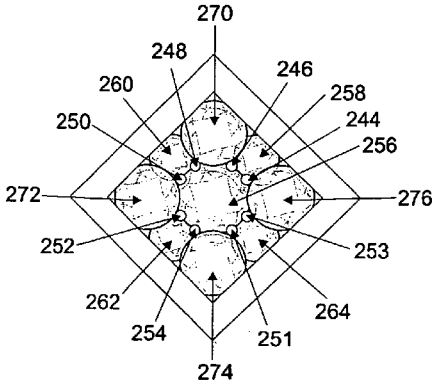
FIG. 44 is a top plan view of a square shaped jewelry mounting illustrating the third step in the mounting process which is mounting the intermediate size stones so that each stone is partially retained within a groove in the interior surface of the outer wall and partially retained by a pair of prongs so that an intermediate stone partially covers and retains the center stone and a pair of outer small stones.
Figure 45:
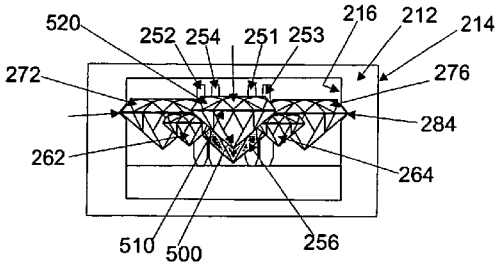
FIG. 45 is a cross sectional view of a square shaped jewelry mounting showing that the center stone is lowest, the small outer stones are at a level above the center stone and the intermediate stones are at a level above the small outer stones, the cross sectional view also showing that the small outer stones are partially retained in a lower groove in the interior surface of the outer wall and the intermediate stones are partially retained in an upper groove in the interior surface of the outer wall.

The stone setting steps for the square shaped mounting 210 are illustrated in FIGS. 42 through 44. The first step in the process is to mount the outer stones in the small sockets. An outer stone 258, 260, 262 and 264 is respectively mounted in an outer socket 220; 222, 224 and 226 so that the pavilion of each small stone is placed within a respective small socket and a portion of the girdle of each small stone is placed within lower groove 282 and is partially retained in a socket by the groove 282. The outer stones are also retained by a respective pair of prongs. Prongs 244 and 246 retain outer stone 258. Prongs 248 and 250 retain outer stone 260. Prongs 252 and 254 retain outer stone 262. Prongs 251 and 253 retain outer stone 264.

The next step in the process is to place the large center stone 256 into the larger center socket 218 so that its pavilion is placed into the socket 218. The center stone 256 is held by the eight prongs 244, 246, 248, 250, 252, 254, 251 and 253 holding the girdle of the large center stone 256.

Figure 48:
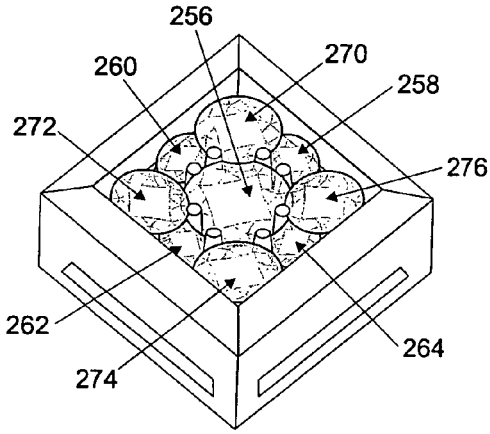
FIG. 48 is a perspective view of a square shaped jewelry mounting illustrating the completed setting of the stones of the present invention.

As illustrated in FIGS. 42, 43 and 48, the outer stones 258, 260, 262 and 264 are at a level below large center stone 256 and the center stone 256 partially overlaps each other stone.

While the setting process has been described as setting the small outer stones 258,260,262 and 264 first, and then setting the large center stone 256, it will be appreciated that it is also within the spirit and scope of the present invention to reverse the process and set the large center stone 256 first and then set the small outer stones 258,260,262 and 264.

The final step in the process is to set the intermediate stones. Each intermediate stone 270, 272, 274 and 276 is respectively placed into an intermediate socket 232, 234, 236 and 238 so that its pavilion is placed into a socket and a portion of its girdle extends into and is partially retained by upper groove 284 and each intermediate stone is also respectively partially retained by a pair of prongs. As illustrated in FIG. 44, prongs 246 and 248 partially retain larger intermediate stone 270, prongs 250 and 252 partially retain intermediate stone 272, prongs 254 and 251 partially retain intermediate stone 274, prongs 253 and 244 partially retain intermediate stone 276. The intermediate stones are above the outer stones and are at the highest level in the setting.

In addition, each intermediate stone partially covers and retains a pair of adjacent smaller outer stones. As illustrated in FIG. 44, in this manner intermediate stone 270 partially covers and thereby partially retains smaller outer stones 258 and 260. Intermediate stone 272 partially covers and thereby partially retains outer stones 260 and 262. Intermediate stone 274 partially covers and thereby partially retains outer stones 262 and 264. Intermediate stone 276 partially covers and thereby partially retains outer stones 264 and 258.

Referring to the perspective view of FIG. 48, it can be seen that the outer stones 258, 260, 262 and 264 are at the lowest level and are partially retained by channel or groove 282 in the interior surface 216 of outer wall 212 and partially retained by a pair of prongs and also partially retained and covered by center stone 256 and an intermediate stone, the center stone 256 is at the next higher level and also partially covered and retained by an intermediate stone and retained by the eight prongs, and intermediate stones 270, 272, 274 and 276 are partially retained by a groove or channel 284 in the interior surface 216 of outer wall 212 and also partially retained by a pair of prongs.

Figure 46:
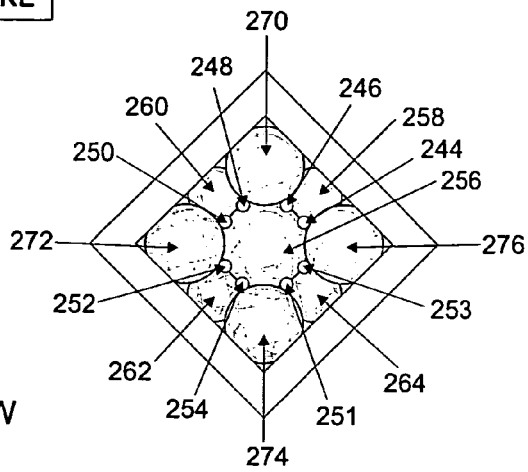
FIG. 46 is a top plan view of a square shaped jewelry mounting illustrating the completed setting of the stones of the present invention.
Figure 47:
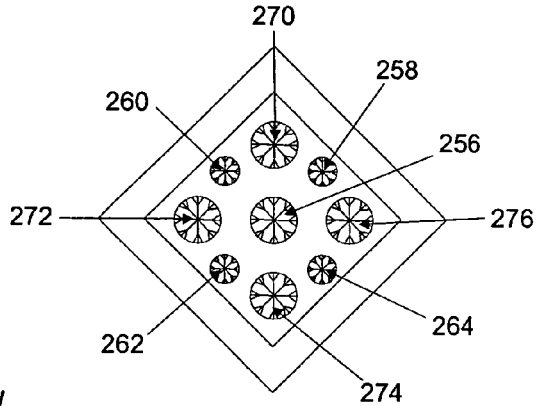
FIG. 47 is a bottom plan view of a square shaped jewelry mounting illustrating the completed setting of the stones of the present invention.

The final finished setting for a square mounting 210 is illustrated in FIGS. 46, 47 and 48.

Figure 49:
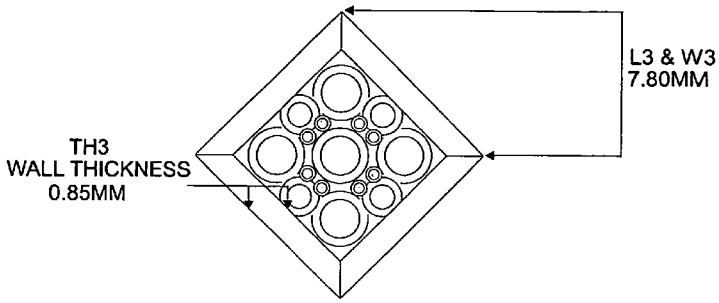
FIG. 49 is a top plan view on a square shaped mounting for a 0.50 carat stone setting showing the length and width of the mounting and the thickness of the outer wall.
Figure 50:
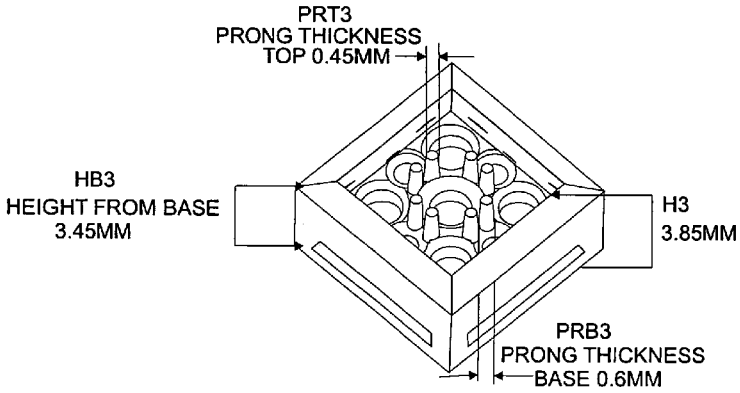
FIG. 50 is a perspective view of a square shaped mounting for a 0.50 carat stone setting showing the height of the outer wall, the height from the top of the mounting to the base level of the tip of the lowest stone, and the thickness of the top and bottom of the prongs.
Figure 51:
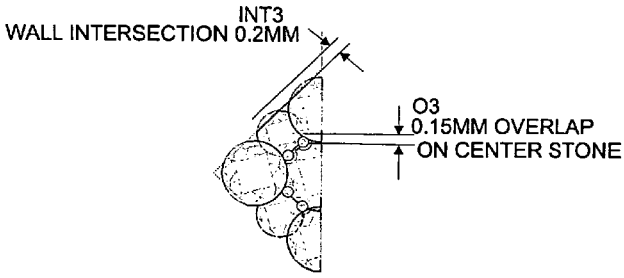
FIG. 51 is a partial top plan view of a square shaped mounting for a 0.50 carat stone setting showing the depth of the groove into which the intermediate stones are set and showing the amount of overlap of an intermediate stone over the center stone.

Referring to FIGS. 49 through 51, there are illustrated various dimensions for a 0.50 carat model square setting. It will be appreciated that these dimensions are provided for illustration only and not limitation and other dimensions are within the spirit and scope of the present invention Referring to FIG. 49, the length L3 and width W3 of the square mounting 210 can be 7.80 millimeters, and the wall thickness TH3 can be 0.85 millimeters Referring to FIG. 50, the overall height H3 of the square shaped mounting 210 can be 3.85 millimeters and the height HB3 from the base 211 to the top of the mounting can be 3.45 millimeters. With respect to the prongs, the width or thickness PRT3 of the top can be 0.45 millimeters and the width or thickness PRB3 of the bottom can be 0.6 millimeters. Referring to FIG. 51, the depth of the girdle on the intermediate stones penetrating into the channel 284 designated as INT 3 can be 0.2 millimeters and the amount of the overlap O3 of each intermediate stone over the center stone 256 can be 0.15 millimeters.

Figure 52:
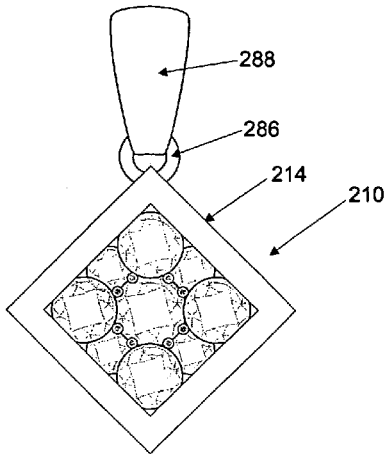
FIG. 52 is a top plan view of a square shaped mounting with all of the stones set therein and the mounting used as a pendant.
Figure 53:
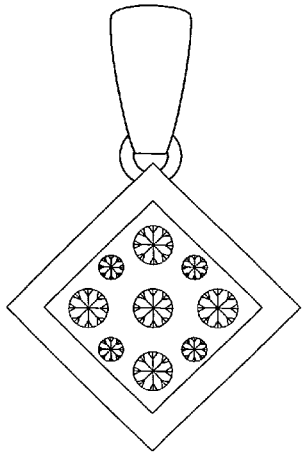
FIG. 53 is a bottom plan view of a square shape mounting with all of the stones set therein and the mounting used as a pendant.
Figure 54:
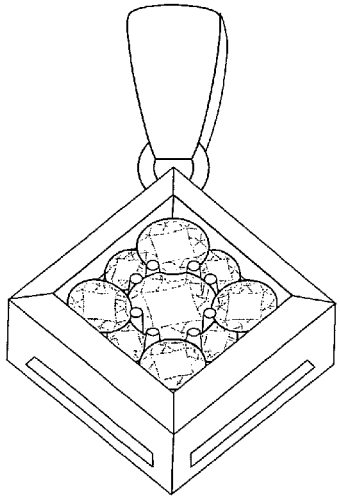
FIG. 54 is a perspective plan view of a square shape mounting with all of the stones set therein and the mounting used as a pendant.
Figure 55:
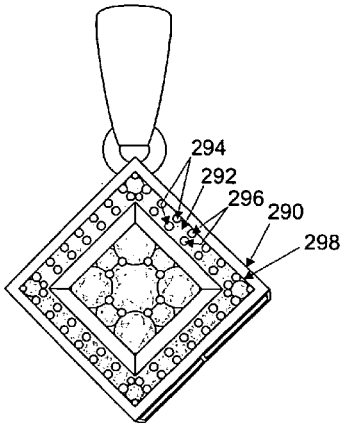
FIG. 55 is a top plan view of a square shape mounting with all of the stones set therein and having an outer bezel comprising a multiplicity of stones with each stone retained by a pair of oppositely disposed prongs, and the entire mounting used as a pendant.
Figure 56:
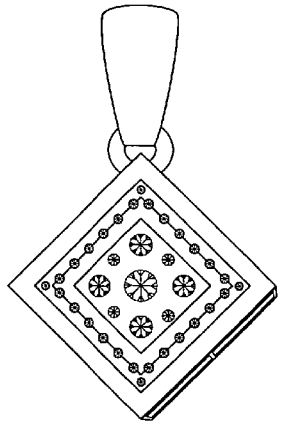
FIG. 56 is a bottom plan view of a square shape mounting with all of the stones set therein and having an outer bezel comprising a multiplicity of stones with each stone retained by a pair of oppositely disposed prongs, and the entire mounting used as a pendant.
Figure 57:
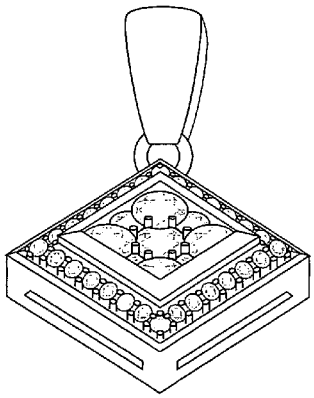
FIG. 57 is a perspective view of a square shape mounting with all of the stones set therein and having an outer bezel comprising a multiplicity of stones with each stone retained by a pair of oppositely disposed prongs, and the entire mounting used as a pendant.

In one use the square shaped mounting 210 with the multiplicity of stones set as previously described can be used in a pendant as illustrated in FIGS. 52 through 54, where a portion of the exterior surface 214 of outer wall 212 is fastened to a ring 286 which in is connected to a sleeve 288 which can be worn on a chain. In another use, referring to FIGS. 55 through 57, a bezel 298 which contains an outer wall 290 having a multiplicity of stones 292 retained by two adjacent pairs of prongs 294 and 296 can be used to further embellish the square shaped mounting 210.

Figure 58:
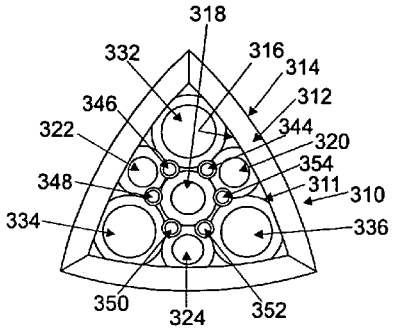
FIG. 58 is a top plan view of a trillion shaped jewelry mounting illustrating the orientation of the prongs and the stone retaining sockets without any precious stones retained thereon.
Figure 59:
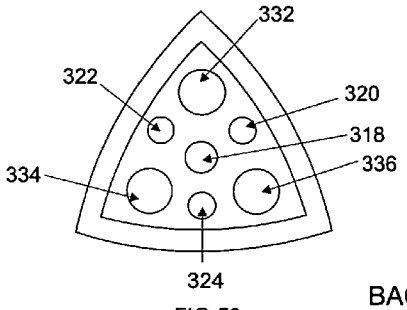
FIG. 59 is a bottom plan view of a trillion shaped jewelry mounting illustrating the bottom of the retaining sockets.
Figure 60:
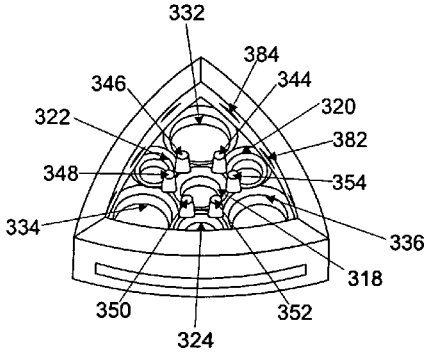
FIG. 60 is a perspective view of a trillion shaped jewelry mounting illustrating the orientation of the prongs and the stone retaining sockets without any precious stones retained thereon.

The present invention technique for setting diamonds and other precious stones will next be described with a trillion shaped mounting which has a mounting base 310. As illustrated in FIG. 58, the trillion shaped mounting base 310 has a floor 311 which is surrounded by an outer wall 312 which has an outer surface 314 and an inner surface 316. Supported on the floor are a multiplicity of sockets into which the precious stones such as diamonds are set. There is a center socket 318 into which a center stone will be placed. Adjacent the portion of the floor 311 which lies adjacent the interior surface 316 of outer wall 312 there are a multiplicity of outer sockets 320, 322 and 324 which are spaced around the interior of the trillion shaped mounting 310. As illustrated in FIG. 60, a portion of each socket 320, 322 and 324 extend into a lower channel or groove 382 in the interior surface 316 of outer wall 312. As illustrated in FIG. 58, the sockets 320, 322 and 324 are at a level which is below center socket 318. Finally, there are a multiplicity of intermediate sockets 332, 334 and 336 wherein a respective intermediate socket is positioned between two outer sockets as illustrated in FIG. 58. As illustrated, all of the intermediate sockets are the same size. As illustrated in FIG. 60, a portion of each intermediate socket 332, 334 and 336 lies adjacent to the interior surface 316 of outer wall 318. Also, as illustrated in FIG. 60, the intermediate sockets 332, 334 and 336 are at a level above outer sockets 320, 322 and 324. FIG. 59 is a bottom plan view of the trillion shaped mounting illustrating how the various sockets appear from the bottom of the mounting.

Finally a multiplicity of prongs 344, 346, 348, 350, 352 and 354 are positioned around center socket 318 so that a respective pair of prongs also lies adjacent an intermediate socket 332, 334 and 336 and a different pair of prongs lie adjacent an outer socket 320, 322 and 324. As illustrated in FIG. 60, the prongs are generally frustum shaped with a flat surface facing the center socket 318.

Figure 61:
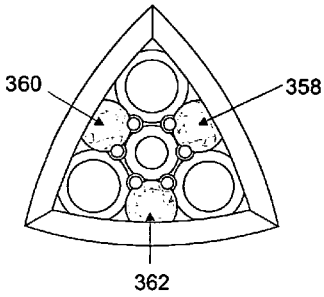
FIG. 61 is a top plan view of a trillion shaped jewelry mounting illustrating the first step in the mounting process which is mounting the outer row of small stones wherein each small stone is placed in a respective outer socket and partially retained within a groove in the interior surface of the outer wall with each of the stones retained by two prongs.
Figure 62:
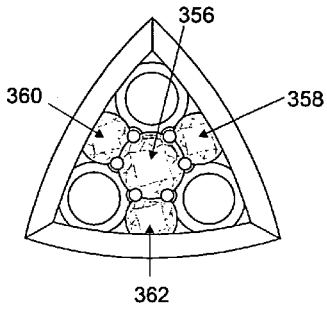
FIG. 62 is a top plan view of a trillion shaped jewelry mounting illustrating the second step in the mounting process which is mounting the center stone in the center socket with the stone retained by six prongs.
Figure 61A:
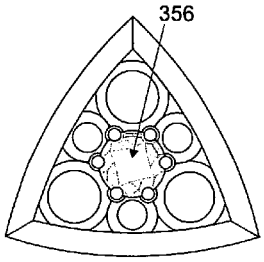
FIG. 61A is a top plan view of a trillion shaped jewelry mounting illustrating an alternative first step in the mounting process which is mounting the center large stone first by mounting the center stone in the center socket with the stone retained by six prongs.
Figure 62A:
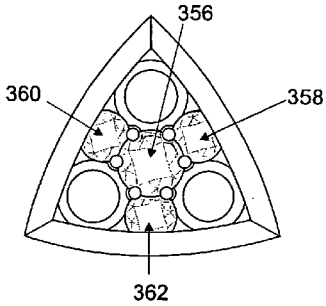
FIG. 62A is a top plan view of a trillion shaped jewelry mounting illustrating the second step when the alternative from FIG. 61A is used, wherein the second step involves mounting the outer row of small stones wherein each small stone is placed in a respective outer socket and partially retained within a groove in the interior surface of the outer wall each stone retained by a pair of prongs.
Figure 63:
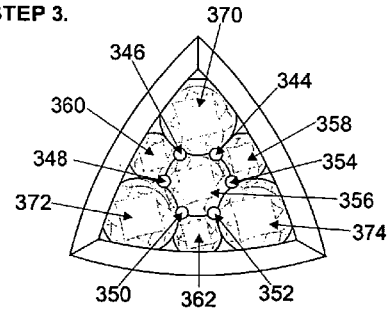
FIG. 63 is a top plan view of a trillion shaped jewelry mounting illustrating the third step in the mounting process which is mounting the intermediate size stones so that each stone is partially retained within a groove in the interior surface of the outer wall and partially retained by a pair of prongs so that an intermediate stone partially covers and retains the center stone and a pair of outer small stones.

The stone setting steps for the trillion shaped mounting 310 are illustrated in FIGS. 61 through 63. The first step in the process is to mount the outer stones in the small sockets. A small stone 358, 360 and 362 is respectively mounted in an outer socket 320, 322 and 324 so that the pavilion of each small stone is placed within a respective outer socket and a portion of the girdle of each small stone is placed within lower groove 382 and is partially retained in a socket by the groove 382. The outer stones are also respectively retained by a pair of prongs. Prongs 354 and 344 partially retain outer stone 358. Prongs 346 and 348 partially retain stone 360. Prongs 350 and 352 partially retain outer stone 362.

The next step in the process is to place the center stone 356 which is slightly bigger than the outer small stones 358, 360 and 362, into the center socket 318, so that its pavilion is placed into the socket 318. The center stone 356 is held by the six prongs 344, 346, 348, 350, 352 and 354 holding the girdle of the center stone 356.

While the setting process has been described as setting the small outer stones 358, 360, and 362 first and then setting the center stone 356, it will be appreciated that it is also within the spirit and scope of the present invention to reverse the process and set the center stone 356 first and then set the small outer stones 358, 360, and 362.

As illustrated in FIGS. 62 and 63, the outer stones 358, 360 and 362 are at a level below center stone 356 and the center stone partially overlaps each other stone.

The final step in the process is to set the intermediate stones. Each intermediate stone 370, 372 and 374 is respective placed into an intermediate socket 332, 334 and 336 so that its pavilion is placed into a socket and a portion of its girdle extends into and is partially retained by upper groove 384 and each intermediate stone is also respectively partially retained by a pair of prongs. As illustrated in FIG. 63, prongs 344 and 346 partially retain larger stone 370, prongs 348 and 350 partially retain intermediate stone 372, and prongs 352 and 354 partially retain intermediate stone 374. The intermediate stones are above the outer stones and the center stone and are at the highest level in the setting.

In addition, each intermediate stone partially covers and retains a pair of adjacent smaller outer stones. As illustrated in FIG. 63, in this manner intermediate stone 370 partially covers and thereby partially retains smaller outer stones 358 and 360. Intermediate stone 372 partially covers and thereby partially retains smaller outer stones 360 and 362. Intermediate stone 374 partially covers and thereby partially retains smaller outer stones 362 and 358. Each intermediate stone also partially overlaps center stone 356 and helps to retain it.

Figure 64:
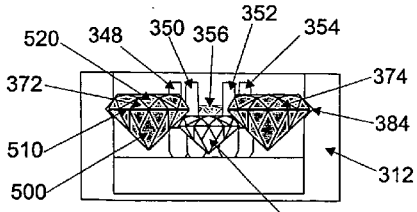
FIG. 64 is a cross sectional view of a trillion shaped jewelry mounting showing that the center stone is lowest, the small outer stones are at a level above the center stone and the intermediate stones are at a level above the small outer stones, the cross sectional view also showing that the small outer stones are partially retained in a lower groove in the interior surface of the outer wall and the intermediate stones are partially retained in an upper groove in the interior surface of the outer wall.

Referring to the cross sectional view of FIG. 64, it can be seen that the smaller outer stones 358, 360 and 362 are at the lowest level and are partially retained by channel or groove 382 in the interior surface 316 of outer wall 312 and at the same time are held by a pair of prongs and also partially covered and retained by an intermediate stone and the center stone, the center stone 356 is at the next level and is retained by six prongs, and intermediate stones 370, 372 and 374 are partially retained by a groove or channel 384 in the interior surface 316 of outer wall 312 and also partially retained by a pair of prongs. Each intermediate stone partially overlaps center stone 356 and also overlaps a pair of outer stones, thereby helping to retain these stones.

Figure 65:
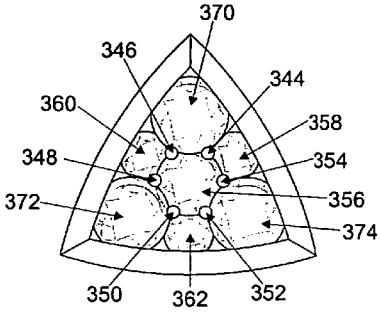
FIG. 65 is a top plan view of a trillion shaped jewelry mounting illustrating the completed setting of the stones of the present invention.
Figure 66:
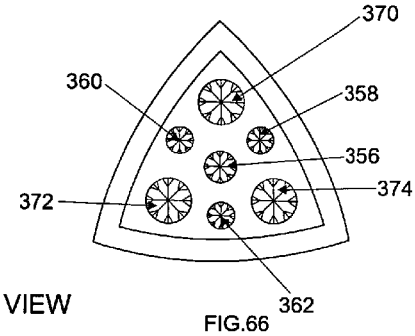
FIG. 66 is a bottom plan view of a trillion shaped jewelry mounting illustrating the completed setting of the stones of the present invention.
Figure 67:
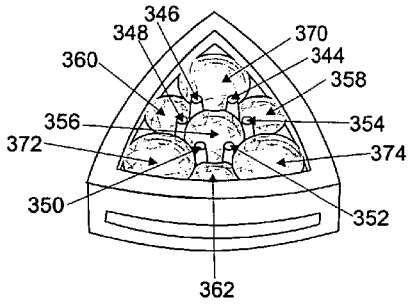
FIG. 67 is a perspective view of an trillion shaped jewelry mounting illustrating the completed setting of the stones of the present invention.

The final finished setting for a trillion mounting 310 is illustrated in FIGS. 65, 66 and 67.

Figure 68:
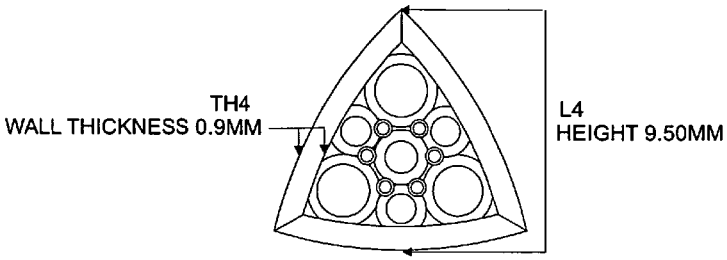
FIG. 68 is a top plan view on a trillion shaped mounting for a 0.50 carat stone setting showing the length and width of the mounting and the thickness of the outer wall.
Figure 69:
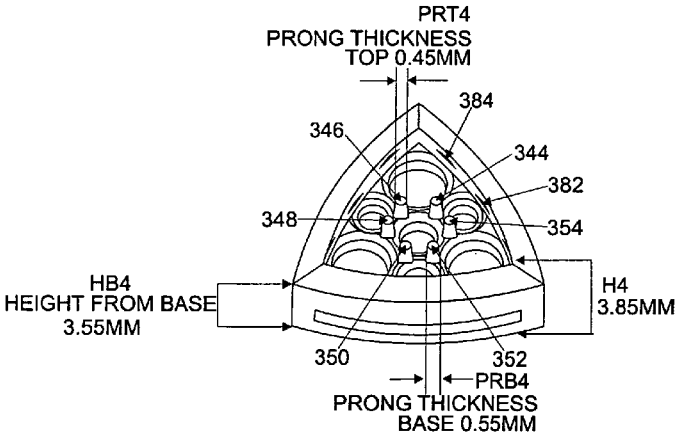
FIG. 69 is a perspective view of a trillion shaped mounting for a 0.50 carat stone setting showing the height of the outer wall, the height from the top of the mounting to the base level of the tip of the lowest stone, and the thickness of the top and bottom of the prongs.
Figure 70:
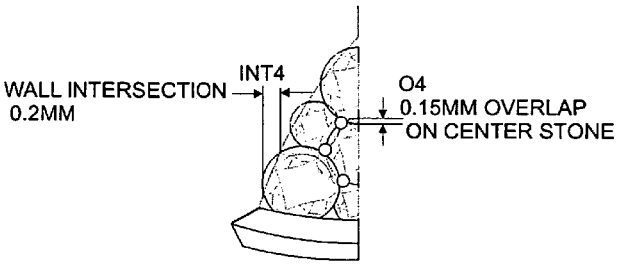
FIG. 70 is a partial top plan view of a trillion shaped mounting for a 0.50 carat stone setting showing the depth of the groove into which the intermediate stones are set and showing the amount of overlap of an intermediate stone over the center stone.

Referring to FIGS. 68 through 70, there are illustrated various dimensions for a 0.50 carat model trillion setting. It will be appreciated that these dimensions are provided for illustration only and not limitation and other dimensions are within the spirit and scope of the present invention Referring to FIG. 68, the length L4 of the trillion mounting 310 can be 9.50 millimeters, and the wall thickness TH4 can be 0.9 millimeters Referring to FIG. 69, the overall height H4 of the trillion shaped mounting 310 can be 3.85 millimeters and the height HB4 from the base 311 to the top of the mounting can be 3.55 millimeters. With respect to the prongs, the width or thickness PRT4 of the top can be 0.45 millimeters and the width or thickness PRB4 of the bottom can be 0.55 millimeters. The prongs are generally frustum shaped but in this design have a flat surface facing the center stone. Referring to FIG. 70, the depth of the girdle on the intermediate stones penetrating into the channel 384 designated as INT 4 can be 0.2 millimeters and the amount of the overlap O4 of each intermediate stone over the center stone 356 can be 0.15 millimeters.

Figure 71:
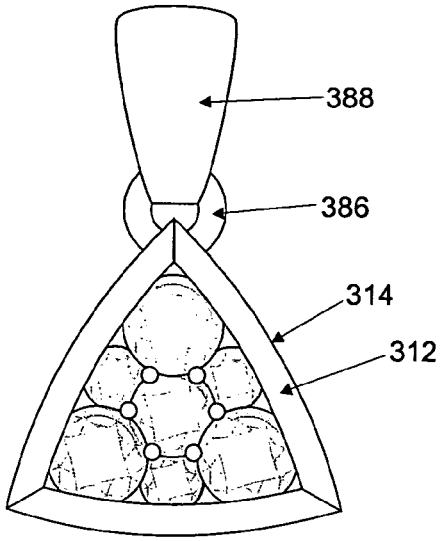
FIG. 71 is a top plan view of a trillion shaped mounting with all of the stones set therein and the mounting used as a pendant.
Figure 72:
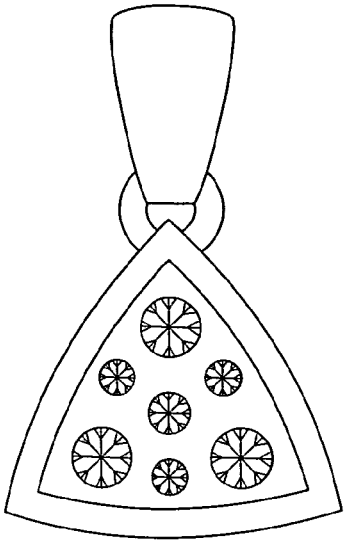
FIG. 72 is a bottom plan view of a trillion shape mounting with all of the stones set therein and the mounting used as a pendant.
Figure 73:
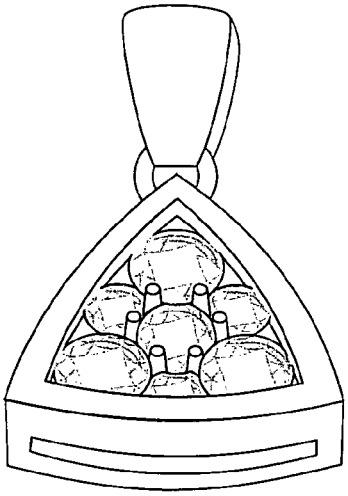
FIG. 73 is a perspective plan view of a trillion shape mounting with all of the stones set therein and the mounting used as a pendant.
Figure 74:
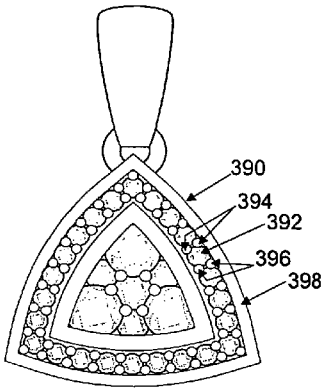
FIG. 74 is a top plan view of a trillion shape mounting with all of the stones set therein and having an outer bezel comprising a multiplicity of stones with each stone retained by a pair of oppositely disposed prongs, and the entire mounting used as a pendant.
Figure 75:
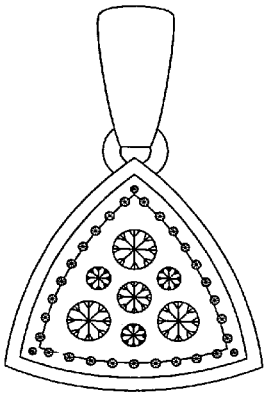
FIG. 75 is a bottom plan view of a trillion shape mounting with all of the stones set therein and having an outer bezel comprising a multiplicity of stones with each stone retained by a pair of oppositely disposed prongs, and the entire mounting used as a pendant.
Figure 76:
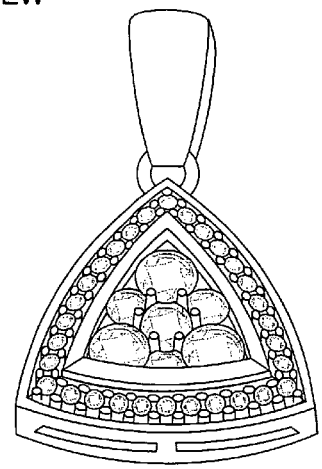
FIG. 76 is a perspective view of a trillion shape mounting with all of the stones set therein and having an outer bezel comprising a multiplicity of stones with each stone retained by a pair of oppositely disposed prongs, and the entire mounting used as a pendant.

In one use the trillion shaped mounting 310 with the multiplicity of stones set as previously described can be used in a pendant as illustrated in FIGS. 71 through 73 where a portion of the exterior surface 314 of outer wall 312 is fastened to a ring 386 which in is connected to a sleeve 388 which can be worn on a chain. In another use, referring to FIGS. 74 through 76, a bezel 398 which contains an outer wall 390 having a multiplicity of stones 392 retained by two adjacent pairs of prongs 394 and 396 can be used to further embellish the trillion shaped mounting 310.

For each stone which has been mounted in each type of setting as discussed above, each stone has a pavilion, a girdle, and a facet. Referring by way of example to FIG. 7, the pavilion of the intermediate stone 76 is shown at 500, the girdle of the intermediate stone is shown at 510, and the crown of the intermediate stone is shown at 520. For each setting technique, when a stone is placed in a socket, it is the pavilion of the stone that is placed in a socket. For each stone which is held by at least one prong, the prong retains the stone at the location of the girdle. When a portion of a stone is placed into either a lower channel in the exterior wall or an upper channel in the exterior wall, it is the girdle of the stone that is placed into the channel. When a stone is partially overlapped by another stone, it is the facet of the lower stone which is overlapped by a portion of the pavilion of the higher stone.

Defined in detail, the first embodiment of the present invention is a technique for setting precious stones in an oval shaped mounting comprising: (a) starting with an oval shaped mounting having an oval shaped exterior wall including an interior surface and a floor with a multiplicity of sockets therein including a center socket, a multiplicity of outer sockets and a multiplicity of intermediate sockets, wherein a portion of each outer socket extends into a lower channel in the interior surface of the outer wall and a portion of each intermediate socket is adjacent the interior surface of the outer wall, the outer sockets being positioned below the intermediate sockets with each outer socket positioned between two intermediate sockets and each intermediate socket positioned between two outer sockets, and a multiplicity of frustum shaped prongs positioned around the center socket; (b) positioning a center stone having a pavilion and a girdle in the center socket so that the pavilion is placed in the center socket and the multiplicity of frustum shaped prongs hold the center stone by its girdle; (c) positioning a multiplicity of outer stones each having a pavilion and a girdle in the outer sockets so that a respective outer stone is placed in a respective outer socket such that its pavilion is placed in the socket and a portion of its girdle is placed into and partially retained by the lower channel in the interior surface of the outer wall; and (d) positioning a multiplicity of intermediate stones each having a pavilion and a girdle in the intermediate sockets so that a respective intermediate stone is placed in a respective intermediate socket such that its pavilion is placed in the socket and a portion of its girdle is placed into and retained by an upper channel in the interior surface of the outer wall, each intermediate stone also partially retained by a pair of frustum shaped prongs such that each intermediate stone partially overlaps the center stone and also partially overlaps a pair of outer stones to thereby partially retain a pair of outer stones.

Defined more broadly, the first embodiment of the present invention is a technique for setting precious stones in an oval shaped mounting comprising: (a) starting with an oval shaped mounting having an oval shaped exterior wall including an interior surface and a floor with a multiplicity of sockets therein including a center socket, a multiplicity of outer sockets and a multiplicity of intermediate sockets, with each outer socket positioned between two intermediate sockets and each intermediate socket positioned between two outer sockets, a multiplicity of prongs positioned around the center socket, the interior surface of the outer wall having a lower channel and an upper channel; (b) positioning a center stone having a pavilion and a girdle in the center socket so that the pavilion is placed in the center socket and the multiplicity of prongs hold the center stone by its girdle; (c) positioning a multiplicity of outer stones each having a pavilion and a girdle in the outer sockets so that a respective outer stone is placed in a respective outer socket such that its pavilion is placed in the socket and a portion of its girdle is placed into and partially retained by the lower channel in the interior surface of the outer wall; and (d) positioning a multiplicity of intermediate stones each having a pavilion and a girdle in the intermediate sockets so that a respective intermediate stone is placed in a respective intermediate socket such that its pavilion is placed in the socket and a portion of its girdle is placed into and retained by the upper channel in the interior surface of the outer wall, each intermediate stone also partially retained by a pair of prongs such that each intermediate stone partially overlaps the center stone and also partially overlaps a pair of outer stones to thereby partially retain a pair of outer stones.

Defined in detail, the second embodiment of the present invention is a technique for setting precious stones in a round shaped mounting comprising: (a) starting with a round shaped mounting having a round shaped exterior wall including an interior surface and a floor with a multiplicity of sockets therein including a center socket, a multiplicity of outer sockets and a multiplicity of intermediate sockets, wherein a portion of each outer socket extends into a lower channel in the interior surface of the outer wall and a portion of each intermediate socket is adjacent the interior surface of the outer wall, the outer sockets being positioned below the intermediate sockets with each outer socket positioned between two intermediate sockets and each intermediate socket positioned between two outer sockets, and a multiplicity of frustum shaped prongs positioned around the center socket; (b) positioning a center stone having a pavilion and a girdle in the center socket so that the pavilion is placed in the center socket and the multiplicity of frustum shaped prongs hold the center stone by its girdle; (c) positioning a multiplicity of outer stones each having a pavilion and a girdle in the outer sockets so that a respective outer stone is placed in a respective outer socket such that its pavilion is placed in the socket and a portion of its girdle is placed into and partially retained by the lower channel in the interior surface of the outer wall, each outer stone also partially retained by a frustum shaped prong; and (d) positioning a multiplicity of intermediate stones each having a pavilion and a girdle in the intermediate sockets so that a respective intermediate stone is placed in a respective intermediate socket such that its pavilion is placed in the socket and a portion of its girdle is placed into and retained by an upper channel in the interior surface of the outer wall, each intermediate stone also partially retained by a pair of frustum shaped prongs such that each intermediate stone partially overlaps the center stone and also partially overlaps a pair of outer stones to thereby partially retain a pair of outer stones.

Defined more broadly, the second embodiment of present invention is a technique for setting precious stones in a round shaped mounting comprising: (a) starting with a round shaped mounting having a round shaped exterior wall including an interior surface and a floor with a multiplicity of sockets therein including a center socket, a multiplicity of outer sockets and a multiplicity of intermediate sockets, with each outer socket positioned between two intermediate sockets and each intermediate socket positioned between two outer sockets, a multiplicity of prongs positioned around the center socket, the interior surface of the outer wall having a lower channel and an upper channel; (b) positioning a center stone having a pavilion and a girdle in the center socket so that the pavilion is placed in the center socket and the multiplicity of prongs hold the center stone by its girdle; (c) positioning a multiplicity of outer stones each having a pavilion and a girdle in the outer sockets so that a respective outer stone is placed in a respective outer socket such that its pavilion is placed in the socket and a portion of its girdle is placed into and partially retained by the lower channel in the interior surface of the outer wall, each outer stone also partially retained by a prong; and (d) positioning a multiplicity of intermediate stones each having a pavilion and a girdle in the intermediate sockets so that a respective intermediate stone is placed in a respective intermediate socket such that its pavilion is placed in the socket and a portion of its girdle is placed into and retained by the upper channel in the interior surface of the outer wall, each intermediate stone also retained by a pair of prongs such that each intermediate stone partially overlaps the center stone and also partially overlaps a pair of outer stones to thereby partially retain a pair of outer stones.

Defined in detail, the third embodiment of present invention is a technique for setting precious stones in a square shaped mounting comprising: (a) starting with a square shaped mounting having a square shaped exterior wall including an interior surface and a floor with a multiplicity of sockets therein including a center socket, a multiplicity of outer sockets and a multiplicity of intermediate sockets, wherein a portion of each outer socket extends into a lower channel in the interior surface of the outer wall and a portion of each intermediate socket is adjacent the interior surface of the outer wall, the outer sockets being positioned below the intermediate sockets with each outer socket positioned between two intermediate sockets and each intermediate socket positioned between two outer sockets, and a multiplicity of frustum shaped prongs positioned around the center socket; (b) positioning a multiplicity of outer stones each having a pavilion and a girdle in the outer sockets so that a respective outer stone is placed in a respective outer socket such that its pavilion is placed in the socket and a portion of its girdle is placed into and partially retained by the lower channel in the interior surface of the outer wall, each outer stone also partially retained by a pair of frustum shaped prongs; (c) positioning a center stone having a pavilion and a girdle in the center socket so that the pavilion is placed in the center socket and the multiplicity of frustum shaped prongs hold the center stone by its girdle; and (d) positioning a multiplicity of intermediate stones each having a pavilion and a girdle in the intermediate sockets so that a respective intermediate stone is placed in a respective intermediate socket such that its pavilion is placed in the socket and a portion of its girdle is placed into and retained by an upper channel in the interior surface of the outer wall, each intermediate stone also partially retained by a pair of frustum shaped prongs such that each intermediate stone partially overlaps the center stone and also partially overlaps a pair of outer stones to thereby partially retain a pair of outer stones.

Defined more broadly, the third embodiment of the present invention is a technique for setting precious stones in a square shaped mounting comprising: (a) starting with a square shaped mounting having a square shaped exterior wall including an interior surface and a floor with a multiplicity of sockets therein including a center socket, a multiplicity of outer sockets and a multiplicity of intermediate sockets, with each outer socket positioned between two intermediate sockets and each intermediate socket positioned between two outer sockets, a multiplicity of prongs positioned around the center socket, the interior surface of the outer wall having a lower channel and an upper channel; (b) positioning a multiplicity of outer stones each having a pavilion and a girdle in the outer sockets so that a respective outer stone is placed in a respective outer socket such that its pavilion is placed in the socket and a portion of its girdle is placed into and partially retained by the lower channel in the interior surface of the outer wall, each outer stone also partially retained by at least one prong; (c) positioning a center stone having a pavilion and a girdle in the center socket so that the pavilion is placed in the center socket and the multiplicity of prongs hold the center stone by its girdle; and (d) positioning a multiplicity of intermediate stones each having a pavilion and a girdle in the intermediate sockets so that a respective intermediate stone is placed in a respective intermediate socket such that its pavilion is placed in the socket and a portion of its girdle is placed into and retained by the upper channel in the interior surface of the outer wall, each intermediate stone also retained by a pair of prongs such that each intermediate stone partially overlaps the center stone and also partially overlaps a pair of outer stones to thereby partially retain a pair of outer stones.

Defined in detail, the fourth embodiment of the present invention is a technique for setting precious stones in a trillion shaped mounting comprising: (a) starting with a trillion shaped mounting having a trillion shaped exterior wall including an interior surface and a floor with a multiplicity of sockets therein including a center socket, a multiplicity of outer sockets and a multiplicity of intermediate sockets, wherein a portion of each outer socket extends into a lower channel in the interior surface of the outer wall and a portion of each intermediate socket is adjacent the interior surface of the outer wall, the outer sockets being positioned below the intermediate sockets with each outer socket positioned between two intermediate sockets and each intermediate socket positioned between two outer sockets, and a multiplicity of generally frustum shaped prongs with a flat longitudinal wall positioned around the center socket; (b) positioning a multiplicity of outer stones each having a pavilion and a girdle in the outer sockets so that a respective outer stone is placed in a respective outer socket such that its pavilion is placed in the socket and a portion of its girdle is placed into and partially retained by the lower channel in the interior surface of the outer wall, each outer stone also partially retained by a pair of frustum shaped prongs; (c) positioning a center stone having a pavilion and a girdle in the center socket so that the pavilion is placed in the center socket and the multiplicity of frustum shaped prongs hold the center stone by its girdle; and (d) positioning a multiplicity of intermediate stones each having a pavilion and a girdle in the intermediate sockets so that a respective intermediate stone is placed in a respective intermediate socket such that its pavilion is placed in the socket and a portion of its girdle is placed into and retained by an upper channel in the interior surface of the outer wall, each intermediate stone also partially retained by a pair of frustum shaped prongs such that each intermediate stone partially overlaps the center stone and also partially overlaps a pair of outer stones to thereby partially retain a pair of outer stones.

Defined more broadly, the fourth embodiment of present invention is a technique for setting precious stones in a trillion shaped mounting comprising: (a) starting with a trillion shaped mounting having a trillion shaped exterior wall including an interior surface and a floor with a multiplicity of sockets therein including a center socket, a multiplicity of outer sockets and a multiplicity of intermediate sockets, with each outer socket positioned between two intermediate sockets and each intermediate socket positioned between two outer sockets, a multiplicity of prongs positioned around the center socket, the interior surface of the outer wall having a lower channel and an upper channel; (b) positioning a multiplicity of outer stones each having a pavilion and a girdle in the outer sockets so that a respective outer stone is placed in a respective outer socket such that its pavilion is placed in the socket and a portion of its girdle is placed into and partially retained by the lower channel in the interior surface of the outer wall, each outer stone also partially retained by at least one prong; (c) positioning a center stone having a pavilion and a girdle in the center socket so that the pavilion is placed in the center socket and the multiplicity of prongs hold the center stone by its girdle; and (d) positioning a multiplicity of intermediate stones each having a pavilion and a girdle in the intermediate sockets so that a respective intermediate stone is placed in a respective intermediate socket such that its pavilion is placed in the socket and a portion of its girdle is placed into and retained by the upper channel in the interior surface of the outer wall, each intermediate stone also retained by a pair of prongs such that each intermediate stone partially overlaps the center stone and also partially overlaps a pair of outer stones to thereby partially retain a pair of outer stones.

Defined in general, the present invention is a technique for setting precious stones in a mounting comprising: (a) starting with a mounting having an exterior wall including an interior surface and a floor with a multiplicity of sockets therein including a center socket, a multiplicity of outer sockets and a multiplicity of intermediate sockets, with each outer socket positioned between two intermediate sockets and each intermediate socket positioned between two outer sockets, a multiplicity of prongs positioned around the center socket, the interior surface of the outer wall having a lower channel and an upper channel; (b) positioning a center stone having a pavilion and a girdle in the center socket so that the pavilion is placed in the center socket and the multiplicity of prongs hold the center stone by its girdle; (c) positioning a multiplicity of outer stones each having a pavilion and a girdle in the outer sockets so that a respective outer stone is placed in a respective outer socket such that its pavilion is placed in the socket and a portion of its girdle is placed into and partially retained by the lower channel in the interior surface of the outer wall; and (d) positioning a multiplicity of intermediate stones each having a pavilion and a girdle in the intermediate sockets so that a respective intermediate stone is placed in a respective intermediate socket such that its pavilion is placed in the socket and a portion of its girdle is placed into and retained by the upper channel in the interior surface of the outer wall, each intermediate stone also partially retained by a pair of prongs such that each intermediate stone partially overlaps the center stone and also partially overlaps a pair of outer stones to thereby partially retain a pair of outer stones.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A technique for setting precious stones in a round shaped mounting comprising:

a. starting with a round shaped mounting having a round shaped exterior wall including an interior surface and a floor with a multiplicity of sockets therein including a center socket, a multiplicity of outer sockets and a multiplicity of intermediate sockets, wherein a portion of each outer socket extends into a lower channel in the interior surface of the outer wall and a portion of each intermediate socket is adjacent the interior surface of the outer wall, the outer sockets being positioned below the intermediate sockets with each outer socket positioned between two intermediate sockets and each intermediate socket positioned between two outer sockets, and a multiplicity of frustum shaped prongs positioned around the center socket;

b. positioning a multiplicity of outer stones each having a pavilion and a girdle in the outer sockets so that a respective outer stone is placed in a respective outer socket such that its pavilion is placed in the socket and a portion of its girdle is placed into and partially retained by the lower channel in the interior surface of the outer wall, each outer stone also partially retained by a frustum shaped prong;

c. positioning a center stone having a pavilion and a girdle in the center socket so that the pavilion is placed in the center socket and the multiplicity of frustum shaped prongs hold the center stone by its girdle;

d. positioning a multiplicity of intermediate stones each having a pavilion and a girdle in the intermediate sockets so that a respective intermediate stone is placed in a respective intermediate socket such that its pavilion is placed in the socket and a portion of its girdle is placed into and retained by an upper channel in the interior surface of the outer wall, each intermediate stone also partially retained by a pair of frustum shaped prongs such that each intermediate stone partially overlaps the center stone and also partially overlaps a pair of outer stones to thereby partially retain a pair of outer stones; and e. the outer wall further comprises an outer surface which is surrounded by a bezel having a multiplicity of stones retained in the bezel, each stone retained by a pair of oppositely disposed prongs.

2. The technique in accordance with claim 1 wherein each stone is a diamond.

3. The technique in accordance with claim 1 wherein the multiplicity of outer sockets comprises six sockets, the multiplicity of intermediate sockets comprises six sockets, and the multiplicity of frustum shaped prongs comprises six prongs.

4. A technique for setting precious stones in a round shaped mounting comprising:

a. starting with a round shaped mounting having a round shaped exterior wall including an interior surface and a floor with a multiplicity of sockets therein including a center socket, a multiplicity of outer sockets and a multiplicity of intermediate sockets, with each outer socket positioned between two intermediate sockets and each intermediate socket positioned between two outer sockets, a multiplicity of prongs positioned around the center socket, the interior surface of the outer wall having a lower channel and an upper channel;

b. positioning a multiplicity of outer stones each having a pavilion and a girdle in the outer sockets so that a respective outer stone is placed in a respective outer socket such that its pavilion is placed in the socket and a portion of its girdle is placed into and partially retained by the lower channel in the interior surface of the outer wall, each outer stone also partially retained by a prong;

c. positioning a center stone having a pavilion and a girdle in the center socket so that the pavilion is placed in the center socket and the multiplicity of prongs hold the center stone by its girdle;

d. positioning a multiplicity of intermediate stones each having a pavilion and a girdle in the intermediate sockets so that a respective intermediate stone is placed in a respective intermediate socket such that its pavilion is placed in the socket and a portion of its girdle is placed into and retained by the upper channel in the interior surface of the outer wall, each intermediate stone also retained by a pair of prongs such that each intermediate stone partially overlaps the center stone and also partially overlaps a pair of outer stones to thereby partially retain a pair of outer stones; and e. the outer wall further comprises an outer surface which is surrounded by a bezel having a multiplicity of stones retained in the bezel, each stone retained by a pair of oppositely disposed prongs.

5. The technique in accordance with claim 4 wherein each stone is a diamond.

6. The technique in accordance with claim 4 wherein the multiplicity of outer sockets comprises six sockets, the multiplicity of intermediate sockets comprises six sockets, and the multiplicity of prongs comprises six prongs.

* * * * *